US005890771A

United States Patent [19]

Cass

[11] Patent Number: 5,890,771

[45] Date of Patent: Apr. 6, 1999

[54] TUNNEL BORING MACHINE AND METHOD

[76] Inventor: David T. Cass, 17063—16th Ave. SW., Seattle, Wash. 98166

[21] Appl. No.: 763,861

[22] Filed: Dec. 11, 1996

[51] Int. Cl.[6] ..... E21D 9/02; E21D 9/08

[52] U.S. Cl. ..... 299/31; 299/33

[58] Field of Search ..... 299/31, 33, 1.8; 405/138, 141

[56] References Cited

U.S. PATENT DOCUMENTS

| | | | |
|---|---|---|---|
| 3,345,108 | 10/1967 | Newman et al. | 299/31 |
| 3,966,256 | 6/1976 | Fikse | 299/31 |
| 3,967,463 | 7/1976 | Grandori | 405/141 |
| 4,122,683 | 10/1978 | Follert et al. | 405/142 |
| 4,140,345 | 2/1979 | Babendererde et al. | 299/11 |
| 4,494,799 | 1/1985 | Snyder | 405/141 X |
| 4,637,657 | 1/1987 | Snyder | 299/31 |
| 4,915,453 | 4/1990 | Fikse | 299/31 |
| 5,205,613 | 4/1993 | Brown, Jr. | 299/31 |

*Primary Examiner*—David J. Bagnell
*Attorney, Agent, or Firm*—Hughes, Multer & Schacht, P.S.

[57] ABSTRACT

A tunnel boring machine particularly adapted to operate at substantial depths below the earth's surface. The machine comprises a head section comprising a cutter head that is rotatably mounted to a support structure. There is a plurality of gripper shoes spaced circumferentially around the support structure, and these are operated to grip the tunnel wall and be selectively operated to advance the machine in the tunnel as the tunneling operation progresses. Also, there is a roof shield positioned immediately behind the cutter head. There is also a pair of support shoes supported from the support structure by links having curved bearing surfaces to maintain the machine at the proper distance above the tunnel invert. There is a beam structure having a forward end connected to the support structure by a universal connection, and the beam structure is supported by a rearwardly positioned gantry. There is also a positioning means to rotate the support structure relative to the beam structure so as to move the head section both laterally and vertically, and also to correct roll orientation.

45 Claims, 14 Drawing Sheets

TUNNEL BORING MACHINE AND METHOD

BACKGROUND OF THE INVENTION a) Field of the Invention

The present invention relates to a machine and method for boring tunnels in the earth strata, and more particularly to such a machine and method which is designed to operate in geological ground conditions where converging conditions exist, such as may exist when a tunnel is being bored at substantial depths below the earth's surface.

There are in the prior art tunnel boring machines which have a forward rotating cutterhead that engages the tunnel end surface to bore into the earth strata, as the machine progresses forwardly into the tunnel. Quite commonly, the machine is moved through the tunnel by means of gripper shoes which are pressed outwardly from the main body of the machine to engage the tunnel side wall and move the machine forwardly from these gripper shoes. The rock fragments and other debris resulting from the boring operation are collected by the rotating cutterhead and deposited on a conveyor to be carried to the rear part of the machine for removal from the tunnel.

As the tunnel is being dug, it is usually necessary to provide support structure for the tunnel side wall, and this is commonly done by providing support rings which are placed circumferentially within the tunnel wall, with these being spaced at longitudinal intervals in the tunnel. Then reinforcing members or material is placed between the rings, followed by placing shotcrete or other structural material against the tunnel side wall.

When a tunnel is being dug at substantial depth below the earth surface, even though the earth strata through which a tunnel is being dug is relatively stable, because of the substantial pressures existing at that depth, the tunnel wall tends to converge. For example, as the cutting head advances through the tunnel, the side wall could "creep" or "flow" radially inwardly. While some of this convergence of the tunnel wall is inevitable at substantial depths below the earth's surface, it is desirable that this be minimized as much as possible.

Also, there are sometimes other geological conditions that dictate that adequate support should be placed in the tunnel side wall as close to the cutting head as is practical, so that the earth strata immediately after the cutterhead be properly supported.

It is toward problems such as these, (and others associated therewith) that the present invention is directed. More specifically, the present invention is particularly directed toward the problem of digging relative large diameter tunnels, such as railroad tunnels, which are to extend through the earth strata at rather substantial depths.

SUMMARY OF THE INVENTION

The apparatus of the present invention is designed to bore tunnels in the earth strata, and is particularly adapted to operate in geological ground conditions where converging conditions exist, such as when a tunnel is being bored at substantial depths below the earth's surface.

The boring machine of the present invention has a front end, a rear end, and a longitudinal axis. It comprises a forward positioned head section comprising a cutter head having a forward cutting face and a perimeter portion. This cutter head is mounted rotatably to a support structure for rotation about a longitudinal axis, in a manner that torque and thrust loads from the cutter head are reacted into the support structure, There is a gripper and propel assembly comprising a plurality of gripper shoes positioned at circumferentially spaced locations adjacent to, and rearwardly of, the perimeter portion of the cutter head.

There is also a plurality of gripper and propel actuating mechanisms operatively connected between the gripper shoes and the support structure to exert both radial and longitudinal force components from the support structure to the gripper shoes. This presses the gripper shoes into gripping tunnel wall engagement and causes longitudinal travel of the shoes relative to the support structure to advance the support structure with the cutter head, while reacting loads from the cutter head to the support structure, through the gripper and propel actuating mechanisms, and through the gripper shoes into adjacent ground strata.

In the preferred form, the machine comprises a beam assembly. This beam assembly comprises first an elongate longitudinally aligned beam structure having a forward end connected to the support structure and extending rearwardly therefrom. There is also gantry means operatively connected to the beam structure rearwardly of the support structure and having tunnel engaging pads means to locate the beam structure relative to the support structure.

Further, in the preferred form, the machine comprises positioning means operatively connected between the support structure and the beam structure to cause relative rotation between the support structure and the beam structure about axes transverse to the longitudinal axis for vertical and lateral alignment and positioning adjustment. More specifically, the positioning means comprises a plurality of positioning cylinders laterally and vertically interconnected between the beam structure and the support structure. The positioning cylinders can be extended and retracted selectively to cause this relative rotation of the support structure relative to the beam structure.

Also, in the preferred form there is roll control cylinder meams operatively connected to the beam structure and the support structure to cause rotation of the support structure relative to the beam structure about the longitudinal axes. This properly positioned the support structure relative to roll orientation.

In the preferred embodiment, the beam structure has at its forward end a universal connection to the support structure to permit rotation or said support structure relative to said beam structure about axes perpendicular to, and parallel to, the longitudinal axis.

Also, in the preferred embodiment, there is support shoe mechanism means positioned below the support structure and in operative engagement therewith. Also, the support shoe means comprises tunnel invert engaging shoe means and link means positioned between the shoe means and the support structure to permit relative longitudinal movement between the support shoe means and the support structure, while maintaining substantially constant vertical spacing therebetween.

In the preferred form, the link means is pivotally mounted for rotational movement, and comprises bearing surface means having a curved bearing surface relative to a pivot mounting location of the link means, thus providing the constant vertical spacing. More specifically, the link means is pivotally connected to the support shoe means for rotation about a pivot location, and extends upwardly from the pivot location. More specifically there is an upwardly facing bearing surface curved circularly about the pivot location. This bearing surface engages a matching bearing surface of the support structure so as to be in rolling contact therewith, and thus provide the constant vertical spacing. The support shoe mechanism further comprises shoe actuating means to move the support shoe means longitudinally relative to the support structure.

In the specific embodiment shown herein, the gripper shoes are located in two sets spaced laterally from one another on opposite sides of the support structure. The machine further comprises a roof shield mechanism positioned above the support structure and adjacent to, and rearwardly of, an upper perimeter portion of the cutter head. The roof shield mechanism comprises a tunnel crown engaging plate means, and force transmitting means positioned operatively between the support structure and the plate support means to press the plate support means upwardly into tunnel crown engagement. More specifically, the roof shield mechanism comprises a parallel linkage interconnecting the support structure and the plate support means. Thus the plate support means can be moved with an upward and downward component of travel while maintaining parallel alignment. Also, the roof shield comprises cylinder means operatively engaged between the support structure and the crown engaging plate means to cause movement of the plate support means relative to the parallel linkage.

A further feature of the present invention is that the support structure has a ring-like configuration with a load bearing section positioned radially inwardly of the plurality of gripper shoes, with load bearing portions of the load bearing section being in substantial transverse alignment with load bearing portions of the gripper shoes.

The gripper and propel mechanisms are each operatively connected to a related one of the gripper shoes. Each of the gripper and propel mechanisms comprises cylinder link means connected between the load bearing section and related gripper shoes and positioned to exert radially outward forces from the load bearing section to the gripper shoes. Further, each of the gripper and propel mechanisms comprises propel cylinder means operatively connected between its related gripper shoe and the load bearing section. Each of the propel cylinder means has a substantial longitudinal alignment component to move the gripper shoes longitudinally.

In the preferred form, the support structure has two oppositely positioned side load bearing portions, an upper load bearing portion, and a lower load bearing portion. These load bearing portions of the support structure are substantially radially aligned with load bearing portions of the gripper shoes and the support shoe means. Thus, radial loads imparted to the gripper shoes and the support shoe means are reacted into the support structure radially with a substantial radially inward force component. The roof shield mechanism is positioned between the two sets of gripper shoes and above the support structure. The plate means of the roof shield mechanism has a load bearing portion in substantial transverse alignment with the Upper bearing portion of the support structure.

In the preferred form, the side, upper and lower portions of the support structure define a center longitudinal through opening from the head section rearwardly to a location rearwardly of the support structure.

In the method of the present invention, a machine is provided as described above.

The actuating mechanisms are operated to exert selectively both radial and longitudinal force components from the support structure to the gripper shoes to press the gripper shoes into gripping tunnel engagement and cause longitudinal travel of the shoes relative to the support structure to advance the support structure with the cutter head. While doing so, the loads from the cutter head are reacted to the support structure, through the gripper and propel actuating mechanisms, and through the gripper shoes into adjacent ground strata.

Also in the method of the present invention, the roof shield mechanism is operated to press the plate support means upwardly into tunnel crown engagement to inhibit downward movement of the tunnel crown.

DESCRIPTION OF THE PREFERRED EMBODIMENT

It is believed that a clearer understanding of the present invention will be obtained by presenting in an initial section of this text an overview of the main components and operation of the present invention, and then describing in following sections the various parts of the present invention in more detail. Then there will be described in a summarizing section an overall review of the operation of the present invention.

A. Introduction and Overview of the Present Invention

Figure 1A:
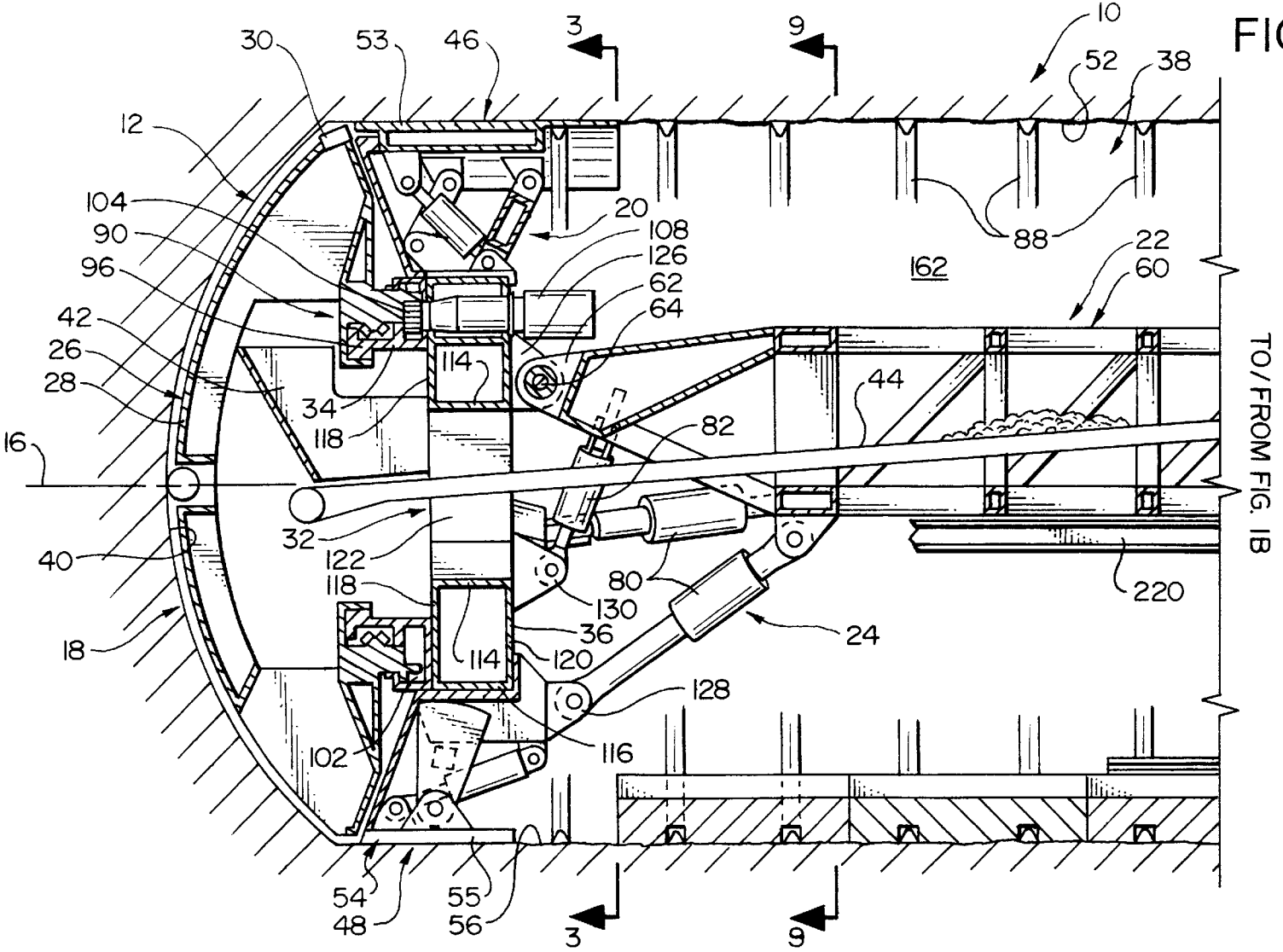
FIG. 1A is a side elevational view, partly in section, of a forward part of the machine of the present invention.
Figure 1B:
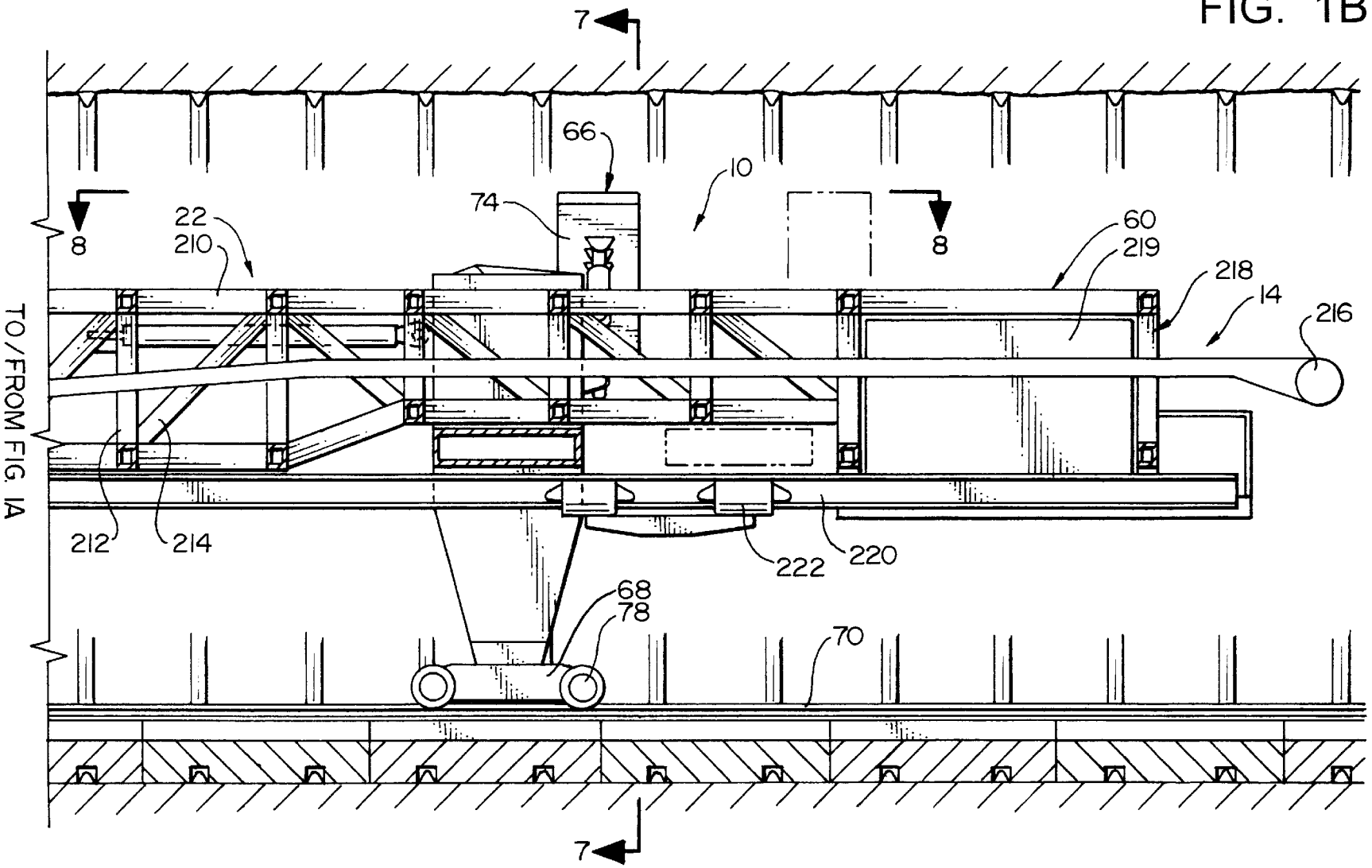
FIG. 1B is a view similar to FIG. 1A, showing the rear portion of the machine.

Reference is made first to FIGS. 1A and 1B, which shows the boring machine of the present invention in side elevational view, with the forward portion being shown partly in section. The machine 10 has a front end 12, a rear end 14, and a longitudinal center axis 16 which extends the entire length of the machine 10. The machine 10 can be considered as having four main sections, namely:

i. a head section 18;

ii. a gripper/propel/tunnel support assembly 20 that is mounted around the perimeter of the head section 18;

iii. a beam assembly 22 which is connected to the rear end of the head section 18 and extends rearwardly therefrom;

iv. a positioning and roll control mechanism 24 which is operatively connected between the front end of the beam assembly 22 and the head section 18.

Each of the these four main components 18–24 will be described in more detail in the following sections. In this introductory section, the main components and operations of each of these main components will be described only briefly, and there will be a general description of how these cooperate with one another in the overall operation of the present invention.

The head section 18 comprises a cutterhead 26 which is mounted at the front end of the head section 18 for rotation about the longitudinal axis 16. This cutterhead 26 is, or may be, of more or less conventional design. As shown herein, the cutterhead 26 has a dome shaped forward section 28 for ground stability considerations, and it has a circumferential, circular perimeter 30. There is a plurality of cutters (in a preferred embodiment as many as seventy discs cutters recess mounted and changed from inside the cutterhead structure. The cutterhead is constructed in sections for handling and transport considerations. Since these cutters are (or may be) conventional, for convenience of illustration, these are not shown in FIG. 1A.

The head section 18 also comprises a cutterhead support structure 32, which in turn comprises two circular structures. there is a forward cutterhead support section 34, to which is mounted cutterhead bearing, ring gear and cutterhead seal assemblies. Then there is a more heavily constructed circular rear support section 36 fixedly connected to and positioned behind the support section 34.

In FIGS. 1A and 1B, the machine 10 is shown positioned within the tunnel 38 that is being bored, with the cutterhead 26 engaging the front tunnel wall 40 of the tunnel 38. As the cutterhead 26 rotates, the cutters cause the rock formation at the front wall 40 to fracture, with the resulting particulate matter being collected by a suitable scoop mechanism in the cutterhead 26. This debris is carried upwardly to be deposited in a collecting hopper 42 to be carried rearwardly through the machine by means of a conveyor 44.

The gripper/propel/tunnel support assembly 20 has three main subassemblies or mechanisms that are positioned behind the cutterhead 26. First there is an upper roof shield mechanism 46 which is positioned at the upper forward part of the machine 10 immediately rearwardly of the gauge cutter at the perimeter edge 30 of the cutterhead 26 to provide ground support close to the gauge cutter in the tunnel crown. Second, there is at the bottom part of the machine a support shoe assembly 48 to provide a constant vertical position of the cutterhead 26 in the tunnel. Third, there is the gripper and ground support shoe assembly 50 (See FIGS. 3, 6A and 6B), which is hereinafter referred to simply as the "gripper shoe assembly 50", and is positioned on opposite sides of the machine 10.

The roof shield mechanism 46 (see FIGS. 4A and 4B), as its name implies, provides a shield and support function at the crown 52 of the tunnel (i.e. the upper surface of the tunnel 38). The roof shield mechanism comprises a roof shield 53 that remains positioned immediately behind (or very closely behind) the upper perimeter edge 30 of the cutterhead 26, and can be operated (as will described later herein) so that the pressure exerted by the roof shield 53 against the tunnel crown 52 can be varied, depending upon the condition of the rock formation, and/or other conditions.

The support shoe assembly 48 (see FIGS. 5A and 5B) comprises a pair of support shoe mechanisms 54, each having a support shoe 55 which provide firm support against the invert 56 of the tunnel 38 (the invert 56 being the bottom wall portion of the tunnel). The manner in which these provide constant vertical positioning of the cutterhead 26 will be described more completely hereinafter in a later section of this text.

The gripper shoe assembly 50 provides the reaction for cutterhead thrust and torque, and also provides ground support until the primary supports are installed behind the gripper shoes. The gripper shoe assembly 50 (see FIGS. 6A–6D) comprises eight gripper shoe mechanisms 58, these being arranged four on each side of the machine 10, with the gripper shoe mechanisms 58 being positioned at circumferentially spaced locations on opposite sides of the machine 10. These gripper shoe mechanisms 58 serve several functions. First, they support and position the forward part of the machine 10 in the tunnel 38. Second, they provide ground support for the tunnel surface on opposite sides of the machine. Third, these shoe mechanisms 58 are operated to advance the machine 10 into the tunnel as the boring operation progresses. In addition, the gripper shoes also have a steering function and other functions.

The beam assembly 22 comprises a main beam 60, the front end 62 of which connects to (and is supported by) a central upper part of the circular support section 36 by means of a universal bearing joint which in the preferred form is a single spherical bearing 64. This beam 60 extends parallel to the longitudinal axis 16 to the rear end 14 of the machine 10.

To support the rear part of the main beam 60, as part of the beam assembly 22, there is provided a gantry 66 through which the beam 60 extends, this gantry 6G being supported by a wheeled trolley 68 that rides upon rails 70 that are laid along the invert 56 of the tunnel as the boring of the tunnel 38 proceeds. This gantry 66 (see FIGS. 7, 8A and 8B) has a bearing and locating means 72 which comprises two bearing pads 74 positioned at upper locations on opposite sides of the gantry 66, just above the spring line 76 (this spring line being the transverse central line of the tunnel 38).

The two bearing pads 74 cooperate with the wheels 78 of the trolley 70 to stabilize and position the gantry 66, so as to maintain the gantry at a fixed position in certain operating modes. As indicated above, the gantry 66 provides support for the beam 60, and among its other functions are the following. First, in certain situations, it reacts certain loads transmitted from the forward part of the machine 10 into the beam 60, into the gantry 66 and into the tunnel side wall. Second, it cooperates with other components to serve an alignment and alignment correction function Third, in certain situations the gantry 66 fixedly positions the machine in the tunnel during at least one mode of operation of the gripper/propel/tunnel support assembly 20.

The positioning and roll control mechanism 24 comprises four positioning cylinders 80 (see FIGS. 9, 10A, 10B and 11) and two roll cylinders 82 (see FIG. 12), these cylinders 80 and 82 being interconnected between the forward part of the beam 60 and the head section structure 36. These cylinders 80 provide a redundant load path from the head section 18, and function in the steering of the cutterhead 26, and also positioning the cutterhead 26 relative to "roll". The manner in which these are accomplished will be described later herein.

To describe briefly the overall operation of the machine 10, let us assume that the tunnel 38 has already been drilled part way into the rock strata, and that the boring operation is to continue. Each gripper shoe mechanism 58 has a related shoe 86, and these shoes 86 are positioned radially outwardly to engage the opposite side walls of the tunnel 38. Propel mechanisms (to be described later herein) of these gripper shoe mechanisms 58 pull the rear support section 36 of the head section 18 forwardly through an increment of forward travel, and thus pull substantially the entire machine 10 forwardly to enable the cutterhead to accomplish its boring operation.

As will be described later herein, the gripper shoes 86 move the machine 10 forwardly in the tunnel 38 in relatively short increments of travel, and then the gripper shoes 86 are moved forwardly to continue the forward movement of the machine 10. This can be accomplished in several different operating modes, which will be described in a later section of this text.

The roof shield mechanism 46, as indicated above, primarily serves as a support and shield function against the crown 52 of the tunnel. In the usual mode of operation, the roof shield 53 itself will remain in contact with the tunnel crown 52, and the pressure exerted by the roof shield 53 against the crown 52 will vary, depending upon the condition of the earth strata through which the tunnel 38 is being bored.

Throughout the boring operation, the bottom support shoes 54 of the support shoe mechanism 48 support the front end of the machine 10 from the tunnel invert 56. These shoes 54 remain stationary on the tunnel invert 56 during each forward increment of travel of the machine 10, and then are moved forwardly to a more forward position adjacent to the lower perimeter edge 30 of the cutterhead 26 for the next increment of travel.

During the boring operation, the main beam 60, being connected to the head support structure 36, travels forwardly in the tunnel as the cutterhead 10 advances in its boring operation. As indicated previously, the gantry 66 performs various positioning, load reacting and alignment functions. The gantry 66 generally remains stationary in the tunnel and is periodically moved forward in the tunnel in relatively large increments of travel as the machine 10 advances. The gantry 66 is generally positioned at approximately the mid-location or a mid-rear location along the beam 60.

As the boring of the tunnel progresses, support structure for the tunnel wall is installed in the tunnel 38 immediately behind the gripper/propel/tunnel support assembly 20. The machine 10 of the present invention is arranged so that the overall method of the present invention is particularly suited where ring steel and shotcrete are used for primary ground support. The tunnel supports are installed behind the gripping mechanism 50, and for a very large machine (e.g. 30 feet in diameter) the tunnel supports could be approximately 2.8 meters behind the gauge cutter of the cutterhead 26. Since the supports are installed behind the gripper shoes 86, the supports are not disturbed by the high radial gripping forces necessary to react the cutterhead thrust and torque. Also, in circumstances where there is high ground pressure with converging conditions, the gripping mechanisms 58 and the roof member 53 can easily support the ground until the supports are installed. Providing the support can desirably accomplished by first positioning expandable support rings 88 in the tunnel as the machine 10 advances, and then adding additional structural material such as shotcrete. The tunnel support structure and the method of installing the same are, or may be, conventional, so this will not be discussed in detail herein.

There now will be a more detail of the various components of the present invention.

B. The Head Section 18

Figure 2:
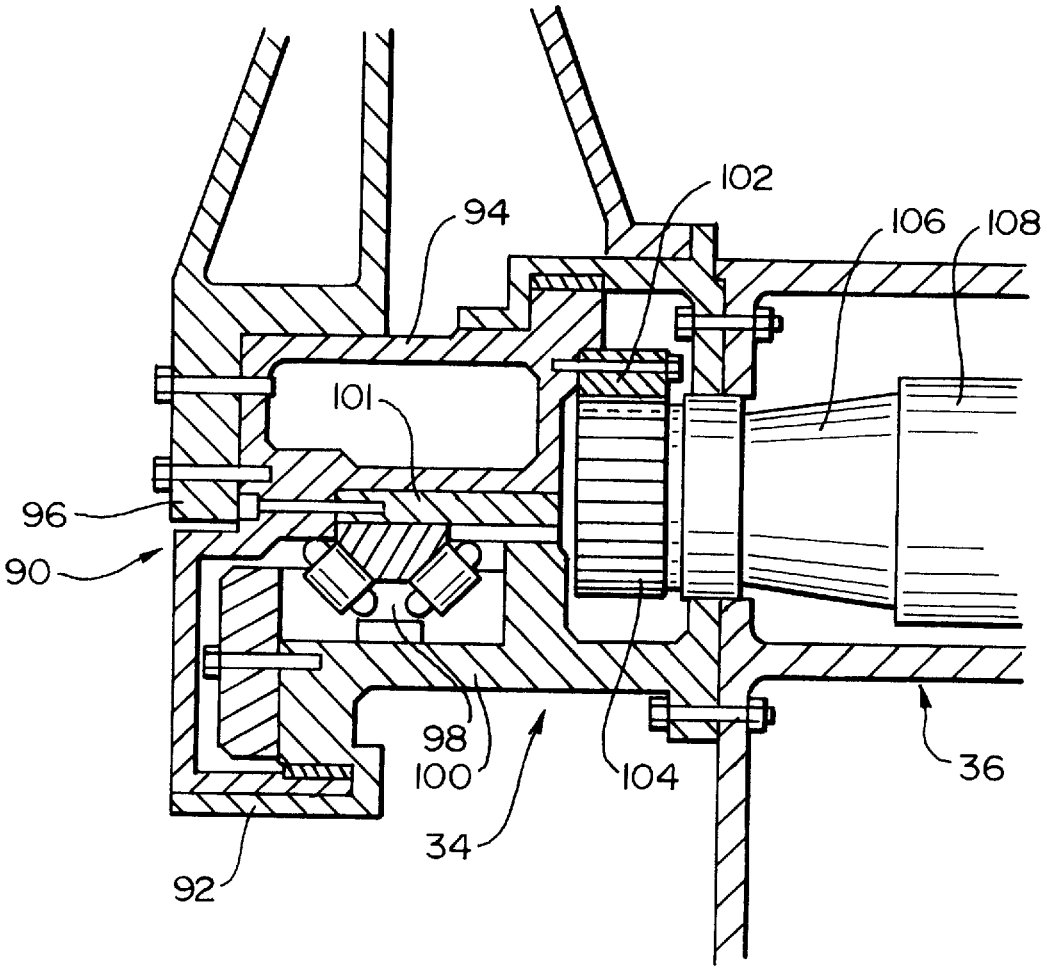
FIG. 2 is a sectional view, drawn to an enlarged scale, of a portion of the mounting and drive interconnection between the cutterhead and the related support structure.

As indicated previously in this text, the head section 18 comprises a cutterhead 26, and also the support structure 32 comprising the front support section 34 and the rear support section 36. The cutterhead 26 can be mounted to the front support section 34 in a conventional manner, and the details of this are shown in FIG. 2. The cutterhead 26 has a mounting structure portion 90 by which it is rotatably mounted to the forward ring support structure 34. The mounting structure 90 has a radially inward cylindrical plate section 92, and a radially outward surrounding section 94 with an interconnection portion being shown at 96. There are radial and thrust bearing assemblies 98, mounted between an inner cylindrical plate 100 of the support structure 34 and a surrounding cylindrical plate 101 of the cutterhead mounting structure 90.

The cutterhead support structure 90 has a ring gear 102, with the teeth of this ring gear 102 facing radially inwardly. This ring gear 102 is engaged by a plurality of drive pinion gears 104, each operably connected to a related drive member 106 that is in turn connected to a related electric motor 108. Seal members and bolt connections are made at various locations indicated in FIG. 2, but since these are (or may be) conventional, these will not be described herein.

It is believed that in viewing FIG. 2 and from the above description, it is evident that as the motors 108 drive the pinion gears 104 that in turn rotates the ring gear 102 to rotate the entire cutterhead 26.

Previously in this text, it was indicated that the support structure 32 comprises the forward cutterhead ring support section 34 and the more heavily constructed rear support section 36. The loads resulting from the engagement of the cutterhead 26 with the tunnel surface 40 are reacted from the cutterhead 26, through the bearing assemblies 98 into the front structure 34 and thence into the rear structure 36. Also, the torque loads due to the resistance to rotation of the cutterhead 26 by its engagement with the tunnel surface 40 are imparted through the ring gear 102, through the pinion gears 104 into the rear structure 36. This ring-like structure 36 functions as the main structural component to react the loads into other operating components in the machine 10, as will be described more fully hereinafter.

Figure 3:
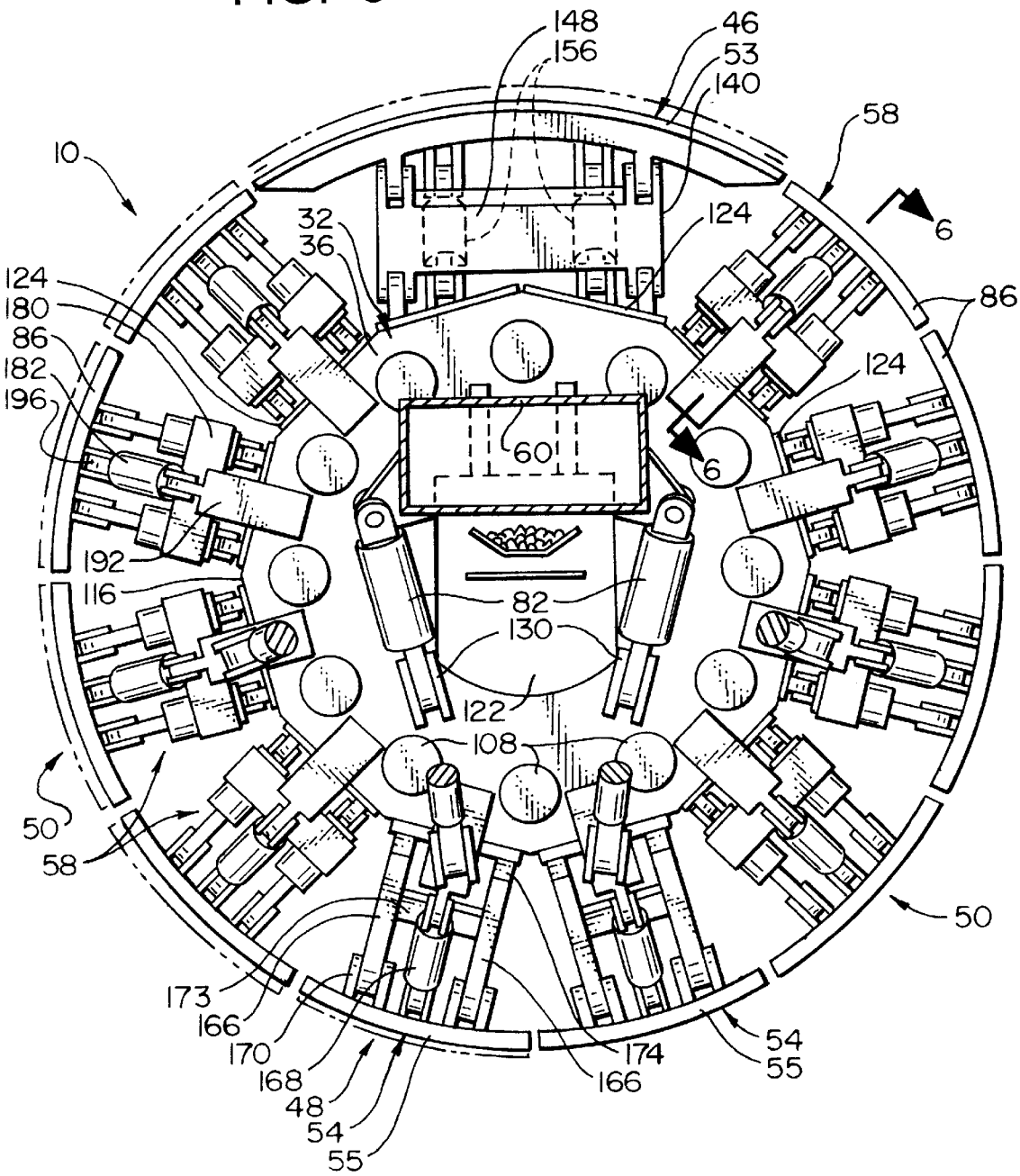
FIG. 3 is a cross sectional view of the machine taken along line 3—3 of FIG. 1A.

This ring-like configuration of the rear support structure 36 can be seen in FIG. 3. Further, it can be seen in FIG. 1A that the cross section at each part of the ring of the structure 36 has a box-like configuration, with radially inward and outward positioned wall sections 114 and 116 respectively, and front and rear wall sections 118 and 120, respectively. Also, this structure 36 defines a central opening 122 for access, and to accommodate the conveyor 44. As can be seen in FIG. 2, the radially outward wall 116 of the support structure 36 further comprises twelve plate sections 124 in a symmetrical, circumferential pattern of a twelve sided polygon. The upper two plate sections 124 provide support for the roof shield mechanism 46, and the bottom two plate sections 124 provide support for the lower shoe mechanism 48, while the remaining eight plate sections 124, four each on opposite sides of the machine 10, provide support for the eight gripper shoe mechanisms 58.

Also, as can be seen in FIG. 1A, at the rear upper middle portion of the support structure 34, there is a rearwardly extending pair of ears 126 which engage the forward end 62 of the beam 60 at the universal bearing member 64. Further, there are four load bearing connections at 128 that connect with the aforementioned positioning cylinders 82, and another two connecting ears 130 that connect to the roll control cylinders 82. The manner in which the various loads imposed on the machine 10 react either into or from the support structure 36 will be described at various locations subsequently in this text.

C. Gripper/Propel/Tunnel Support Assembly 20 (hereinafter called the "gripper and support assembly")

While the term Gripper/Propel/Tunnel Support Assembly is reasonably descriptive of some of the main functions of this assembly 20, and although this assembly 20 actually performs functions in addition to those recited in the title, for convenience, in the text that follows, this designation will simply be shortened to the "gripper and support assembly 20", this being done with the understanding that this designation is not intended to be limiting as to the various functions performed by this assembly 20.

Also, with regard to the nomenclature, in this text the term "cylinder" is used (as is common in the tunnel boring art) in a broader sense to refer (unless specified otherwise) not simply to the cylindrical portion of a cylinder and piston assembly, but to the entire cylinder and piston assembly.

In the following text, the three main components of the gripper and support assembly 20 will be described in three separate sub-sections.

1. The Roof Shield mechanism 46

Figure 4A:
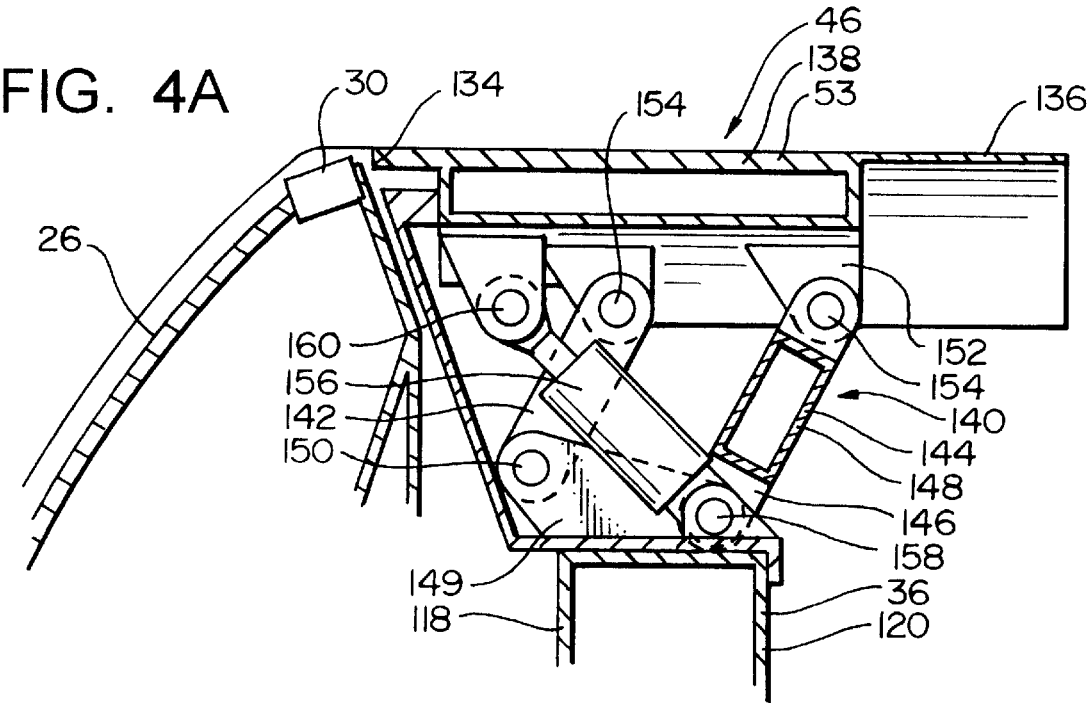
FIGS. 4A and 4B are cross sectional views taken along line 4—4 of FIG. 3, showing the roof shield mechanism.
Figure 4B:
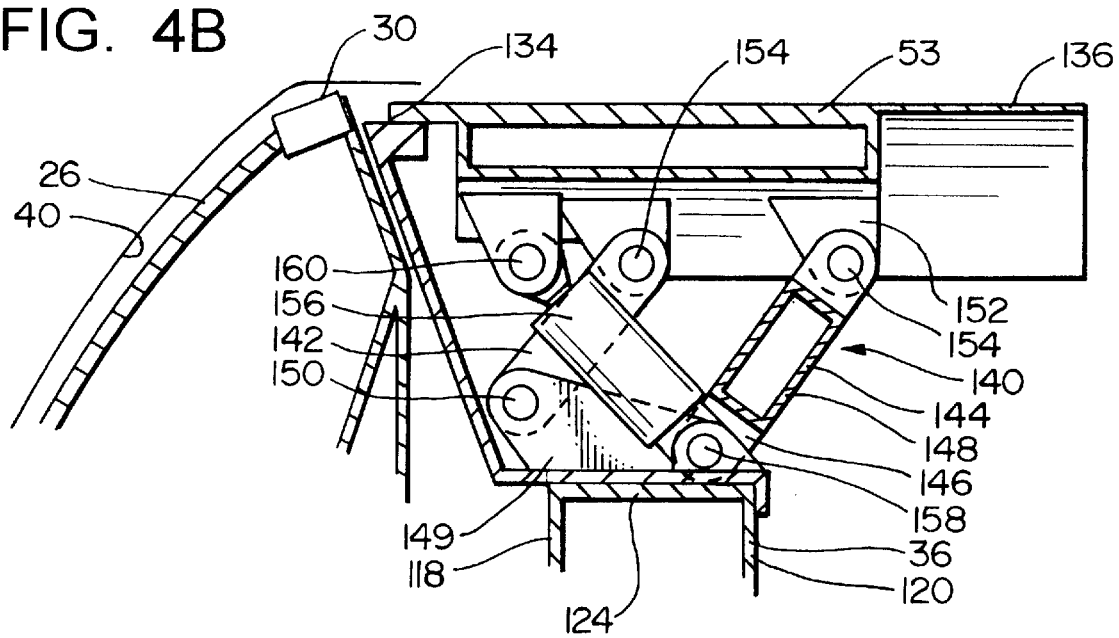

Reference is made to FIGS. 4A and 4B, which show the roof shield mechanism 46 in transverse section, and also to FIG. 3. This shield member 53 is an arcuate plate-like member following an arcuate curve coinciding with the circumference of the perimeter of the machine 10. This is shown as having an arcuate length of seventy degrees, but this could be made longer or shorter, depending on a number of factors. This shield member 53 has in cross section a reinforced box-like construction to withstand the potentially heavy loads which could be encountered from the crown 52 of the tunnel. The forward edge 134 of the shield member 53 is positioned a short distance rearwardly of the perimeter 30 of the cutterhead 26, and the rear part of the shield member 53 has a rearwardly extending tail portion 136 which is simply a rearward extension of the upper arcuate plate 138 of the shield member 53.

During operation of the machine 10, the support rings 88 are initially placed within this tail portion 136. After the machine 10 has moved further forward, so that the support ring 88 is no longer within the tail portion 136, the support ring 88 is expanded against the tunnel wall to perform a support function. After that, further reinforcing structure can be positioned between adjacent support rings 88, and then shotcrete or other structural support material for the tunnel wall can be applied.

The shield member 53 is supported by a parallel linkage 140 which enables the shield member 53 to be moved radially outwardly or inwardly, while maintaining substantial parallel alignment with the longitudinal center axis 16. Specifically, this linkage 114 comprises two separate forward links 142 and a rear link 144 comprising a pair of laterally spaced arms 146 joined together by a cross member 148 (See FIG. 3). The links 142 and arms 146 are mounted from related brackets or ears 149 mounted to the support structure 36 at pivot locations 150, and there are also upper brackets 152 at which there are pivot connections 154 for the upper ends of the links 142 and 144.

To position the shield member 53 and press it against the tunnel crown 52, there is a pair of cylinders 156, each connected at a lower rear pivot connection 158 to the rear radially outward part of the support structure 36, and connected at the forward end at a pivot connection 160 at the lower forward edge portion of the shield member 53. The two positioning cylinders 156 extend from the pivot locations 158 radially outwardly and forwardly at an angle of about 45° to the longitudinal axis 16. In the position shown in FIG. 4A, the links 142 and 146 extend radially outwardly and rearwardly at an angle of about 600 to the longitudinal axis 16. Thus, it can be seen that as the cylinders 156 are extended, the rotation of the links 142 and 146 is upwardly and forwardly to move the shield member 132 radially outwardly. As can be seen in FIG. 5B, when the cylinders 156 are retracted, the shield member 53 moves radially inwardly (i.e. downwardly).

In the normal mode of operation, the shield member 132 will always maintain contact against the tunnel crown 52. When the tunnel 38 is being bored at substantial depths beneath the ground surface, it can be expected that the rock strata through which the tunnel 38 is being bored will contract or "creep" at a slow rate radially inwardly, usually with a higher rate of flow being expected at the location of the crown 52 and a slower rate of flow along the side wall portions 162 in the tunnel. (However, this could vary, depending on conditions.)

As a practical matter, at substantial depths, a certain amount of such flow cannot be prevented. However, it can be alleviated to some extent until the machine 10 has advanced far enough so that the support rings 88 and other reinforcing can be applied. Even then, later there could be further "contraction" of the tunnel surface, and the support rings 88 and other support structure are designed to accommodate this.

In practice, depending upon the ground strata, the pressure in the cylinders 156 is set at a predetermined level to cause the shield 138 to exert the desired pressure against the tunnel crown 52. As the machine 10 moves forwardly in the tunnel 38, the upper surface of the shield member 132 will slide or "scuff" along the tunnel crown 52, still applying an upward pressure against the tunnel crown 52.

2. The Support Shoe Assembly 48

Reference is made to FIGS. 1A, 3, 5A and 5B. As described previously the support shoe assembly 48 comprises the two support shoe mechanisms 54 spaced laterally from one another at the lower forward end of the machine 10, with each of these having a support shoe 55. Each shoe 55 has an arcuate curve matching that of the tunnel invert 56. Each mechanism 54 further comprises two roll links 166, and a positioning cylinder 168. Each shoe 55 has two pairs of upstanding connecting ears 170, to which the lower ends of its related two roll link 166 are connected at 172.

The two links 166 are rigidly interconnected by a cross member 173. The upper end of each roll link 166 has a circularly curved upper bearing surface 174, with the curve of the bearing surface 174 having a radius of curvature with the pivot location 172 as its center. The upper bearing surfaces 174 of the two links 166 press against a downwardly facing bearing surface 176 of a structural member 178 connected to the support structure 36.

Figure 5A:
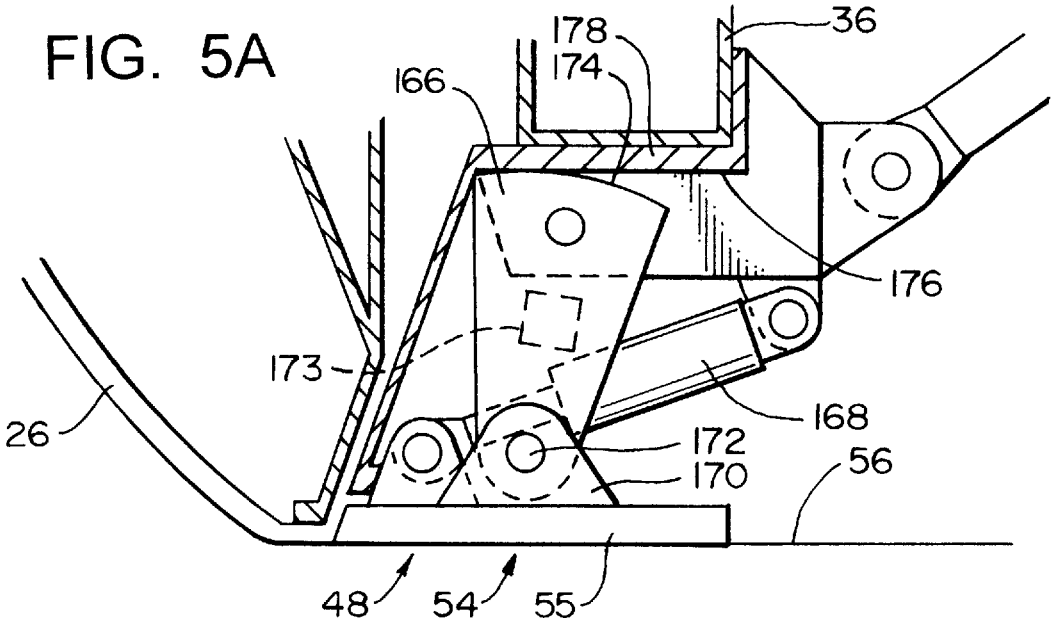
FIGS. 5A and 5B are sectional views, drawn to an enlarged scale, taken along the same section line as FIG. 1A, showing the support shoe mechanism in two different positions.
Figure 5B:
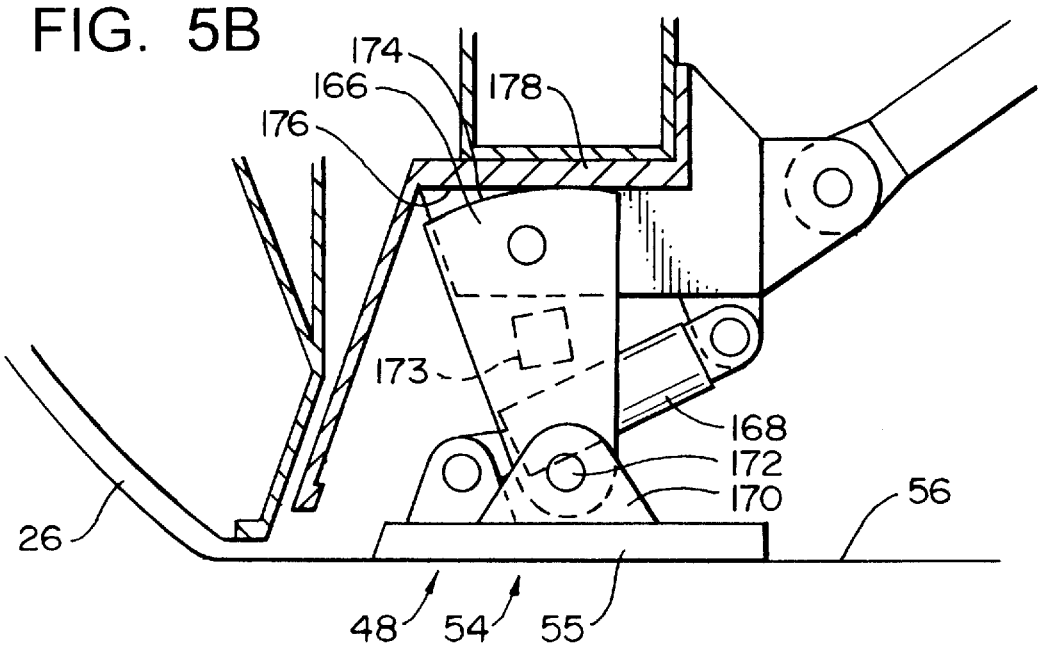

In operation, at the start of each forward increment of travel of the machine 10, the two shoes 55 are positioned at a more forward position, as shown in FIG. 5A. The two shoes 55 remain at a fixed position relative to the tunnel invert 56, and as the machine moves forwardly, the two bearing surfaces 174 and 176 remain in rolling contact, with the two roller links 166 rotating forwardly about the pivot connection 172. It can be seen that in FIG. 5B, the machine 10 has completed that particular segment of forward travel, and the two bearing surfaces 174 and 176 remain in contact.

It is apparent from observing the operation of the support shoe mechanisms 54 that the distance from each of the shoes 55 to the upper bearing surface 176 remains constant throughout the forward increment of travel. During this time, the shoes 55 support the weight of the forward part Of the machine 10, and also react (at least in part) the vertical forces exerted by the tunnel crown 52 against the roof shield member 53. When the forward increment of travel has been completed, to move the shoes 55 back to a forward position, as shown in FIG. 5A, the cylinders 168 are extended. After the cylinders 168 are extended, the hydraulic pressure in the cylinders 168 is reduced to zero or to a low level so that the shoes 55 can remain in proper stationary contact with the tunnel invert 56, with the cylinders 168 "floating" as the machine 10 advances.

3. The Gripper Shoe Assembly 50

Figure 6A:
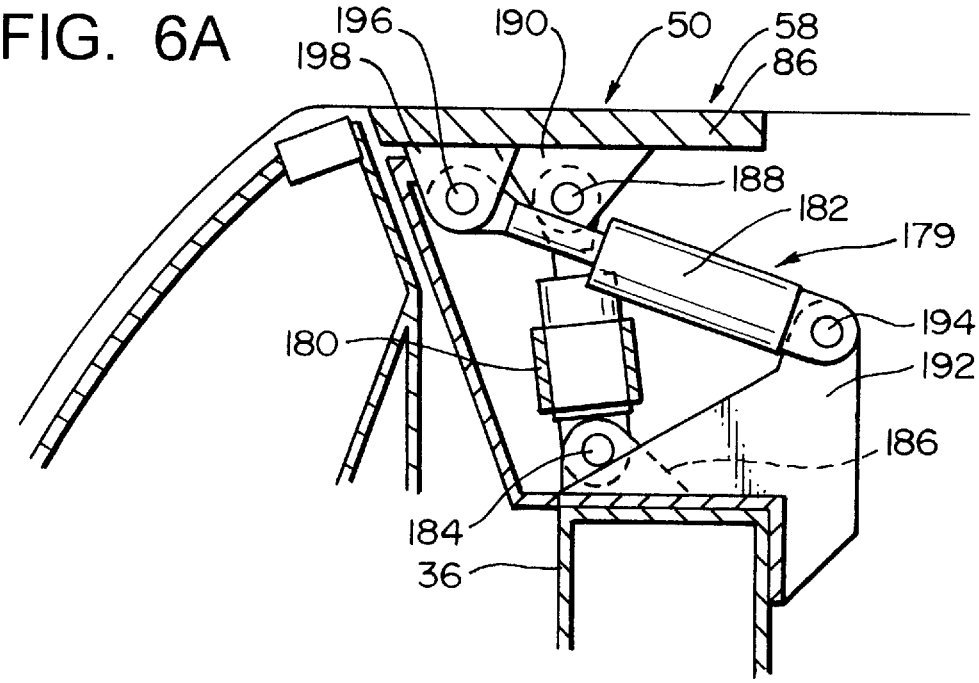
FIGS. 6A and 6B are sectional views taken along line 6—6 of FIG. 3, showing the gripper shoe mechanism of the present invention in two different operating positions.
Figure 6B:
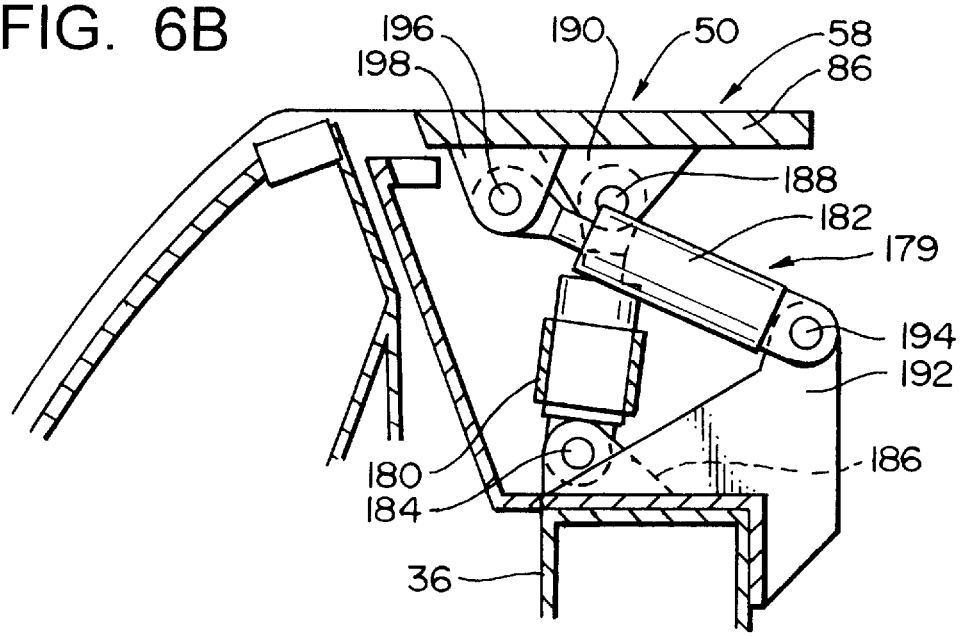

Reference is made to FIGS. 3, 6A and 6B. As indicated previously this gripper shoe assembly 50 comprises a total of eight gripper shoe mechanisms 58 positioned on opposite sides of the machine 10, as shown in FIG. 3. Each gripper shoe mechanism 58 comprises the gripper shoe 86, and a gripper and propel actuating mechanism 179 which comprises a pair of cylinder links 180 and a propel cylinder 182. Each cylinder link 180 is pivotally connected at its radially inward end at a pivot location 184 where each cylinder link 180 is mounted to a related pair of ears 186 adjacent to the outer surface of the support structure 36. The radially outward end of the cylinder link 180 connects at an outer pivot location 188 to a pair of ears 190 connected at a forward to rear center location to the inner surface of the related shoe 86.

To properly mount and position the propel cylinder 182, there is provided a mounting bracket 192 which is connected to the radially outward surface of the mounting structure 36, and provides a connecting pivot location at 194 which is radially outward of, and just a short distance rearwardly of, the outer rear edge of the support structure 36. The propel cylinder 182 extends from this pivot location 194 forwardly at a moderate radially outward slant to connect at a forward pivot location 196 to a pair of ears 198 connected to the forward inside center portion of the related shoe 86.

One main function of the gripper shoe assembly 50 is, as described previously, to grip the side wall of the tunnel on opposite sides of the machine 10 and provide a stationary reaction member to react the force of the propel cylinder 182 to advance the machine 10 one increment of travel. Also, the gripper shoe assembly 50 provides radial support for the adjacent tunnel wall. Further, as indicated previously herein, there are several modes of operation for the gripper shoe mechanisms 58, and these will be described later herein.

In FIG. 6A, the gripper shoe 86 is at its most forward position, and the propel cylinder 182 is in an extended position. It can be seen that the cylinder links 180 extend radially outwardly, but at a moderate forward slant of less than about 10° relative to a radius line drawn perpendicular to the longitudinal axis 16. As the propel cylinder 182 retracts, it moves the machine 10 forward relative to the shoe 86.

As the machine 20 moves forward, the two links 180 rotate rearwardly about the pivot location 184, until at the completion of the increment of travel the two links 180 extend radially outwardly but at a rearward slant at a little less a 10° from a radius line drawn perpendicular to the longitudinal axis 16. The pressure in the cylinder links 180 is set at a predetermined pressure level in the gripping mode, and the length of the links 180 can change slightly as the cylinder links 180 rotate.

The propel cylinders 182 are grouped in quadrants, with four pumps delivering an equal volume of oil to each quadrant. With this arrangement, the pressure in each quadrants automatically adjusts to react eccentric loads on the cutter head. The manner in which the flow to the propel cylinder is utilized for direction and advance control are discussed later in this text.

Figure 6C:
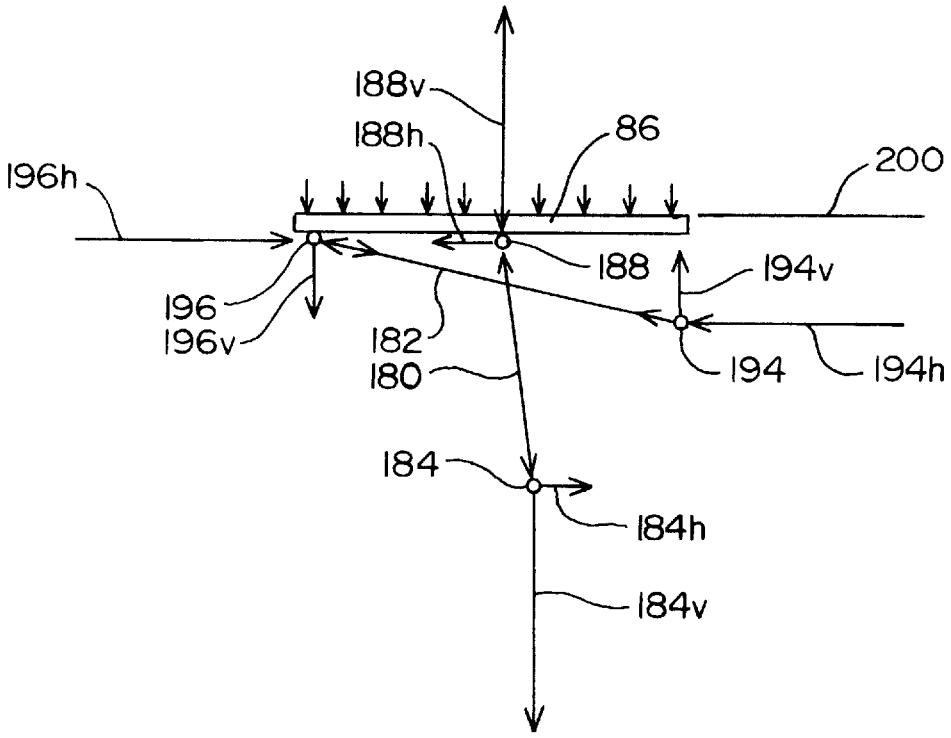
FIG. 6C and 6D are schematic views taken at the same location as FIGS. 6A and 6B, and illustrating the force components resulting from the operation of the gripper shoe mechanism of FIGS. 6A and 6B.
Figure 6D:
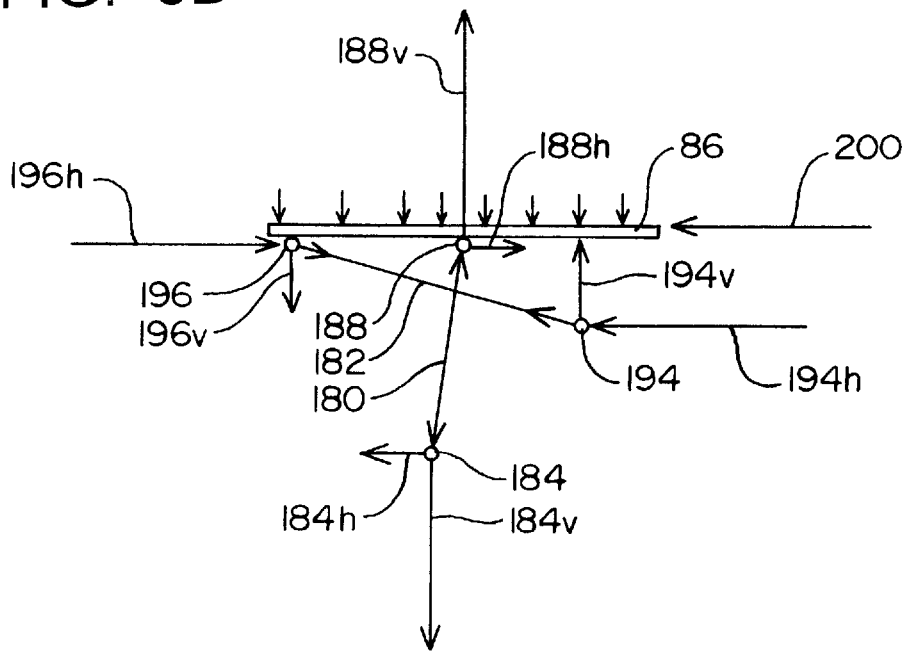

Let us now examine the operation of the gripper shoe mechanism 58 in terms of the manner in which the various forces are transacted into the components, and to do this reference is made to FIGS. 6C and 6D. In FIG. 6C, there is shown the shoe 86 and the four locations at which the forces from the propel cylinder 182 and the cylinder link 180 are transmitted, these being the pivot locations 184, 188, 194, and 196.

FIG. 6C corresponds to the position of the shoe 86 in FIG. 6A, when the stroke of the propel cylinder 182 is just beginning. This is a tension force, as indicated by the arrows pointing toward each other at the line 182, representing the propel cylinder 182. On the other hand, the force exerted by the cylinder links 180 is a compression force pushing from the pivot locations 184 against the pivot points 188 which is at approximately the longitudinal center of the shoe 86.

The force exerted by the propel cylinder 182 at the point 194 can be divided into two force components, namely a horizontal force component 194*h* and vertical force component 194*v*. Those forces are reacted into the bracket 192 which are in turn reacted into the support structure 36. The force exerted by the propel cylinder 182 at the pivot location 196 can be divided into the horizontal force component 196*h* and the vertical force component 196*v*. The horizontal component 196*h* is exerted into the shoe 86, and this is in turn reacted into the tunnel wall surface as a longitudinal force parallel force parallel to the tunnel wall, this being a forward horizontal force component indicated by the arrow 200.

The compressive force at 180 that is reacted at 184 into the support structure 36, as a vertical force component 184*v* and a horizontal force component 184*h*. At the other pivot point 188, the force from the cylinder link 180 has a vertical force component 188*v* urging the shoe 86 against the tunnel wall, and a horizontal force component 188*h* which urges the shoe 86 in a forward direction.

In the situation of FIG. 6C, the horizontal force components 196*h* and 188*h* oppose each other, but considering the more horizontal alignment of the propel cylinder 182, there is a substantial net rearward force exerted on the shoe 86 from the machine 10, which is resisted in the tunnel wall, this being indicated by the force 200.

The vertical force component 188*v* is opposed by the vertical force component 196*v*, but here the alignment of the cylinder links 180 are such that the force component 188*v* is much larger. The force component 188*v* must be sufficient, relative to the coefficient friction of the tunnel wall against the shoe 86, so that the shoe 86 is able to grip the tunnel wall without sliding.

Now we turn our attention to FIG. 6D, which corresponds to position shown in FIG. 6B. It can be seen that the net vertical force 188*v* pushing the shoe 86 has changed little. Also, although the propel cylinder 182 has decreased in length, the alignment has changed only slightly. However, the horizontal force component 184*h*, which is relatively small, is now directed in a rearward direction. This is now additive to the horizontal force exerted at 194*h*, and in this instance, is thus adding to the force which moves the machine 10 in a forward direction.

It is apparent that the two bearing locations 184 and 188 of the cylinder links 180 are in substantial transverse alignment with one another relative to the longitudinal axis 16. Thus the gripping forces exerted by the cylinder links 180 are substantially radially inward from the gripping shoes 86 to the support structure 36.

With the foregoing analysis having been presented, let us now analyze the net effect of this. The horizontal force component 184*h* is relatively minor compared to the force component exerted at 194*h*. Thus, in the position of FIG. 6A, the net force which must be generated by the propel cylinder 182 would be somewhat greater. When the shoe 86 is about half way between the position of FIG. 6A and 6B, so that the cylinder link 180 is aligned perpendicular to the longitudinal axis 16, the horizontal force component 184*h* diminishes to zero. Then at the position of FIG. 6B, the horizontal force component 184*h* is reversed so that it is actually helping the propel cylinder 182 pull the machine 10 forward.

Let us now consider the reverse situation, where the shoe 86 is being moved forwardly from the position of FIG. 6B to FIG. 6A. In the normal course of operations, the shoes 86 in addition to providing their role of advancing the machine 10 in the tunnel, also provide a rock strata stabilizing function, in that these shoes 86 continue to press outwardly against the tunnel side wall, even when they are moving forward. As indicated previously, particularly at depths far below the earth's surface, the rock strata tends to gradually "creep" or "flow" into the void of the tunnel. It is important that this be resisted, as much as is practical, until the reinforcing rings and other tunnel reinforcing structure can be put into place.

The shoes 86 could be advanced by having one set of diametrically opposed shoes 86 gripping the side of the tunnel with a substantially higher force, while the shoes which are to be moved forwardly would have force exerted by their respective cylinder links 180 diminished (to diminish the force of friction against the tunnel wall) so that these shoes 86 can be moved forwardly, while still having something of a support function against the tunnel side wall surface.

As indicated previously, there are at least three modes in which the gripper/propel mechanism can be operated. This will be described later in the final section summarizing the overall operation of the present invention.

D. The Beam Assembly 22

As indicated earlier herein, the beam assembly 22 comprises the main beam 60 and the gantry 66, with the forward end 62 of the beam 60 connected through a universal bearing 64 to the front main support structure 36, and the rear portion of the beam being supported from the gantry 66. To describe these components more particularly, reference will be made to FIG. 1A, 1B, 7, 8A and 8B.

Figure 7:
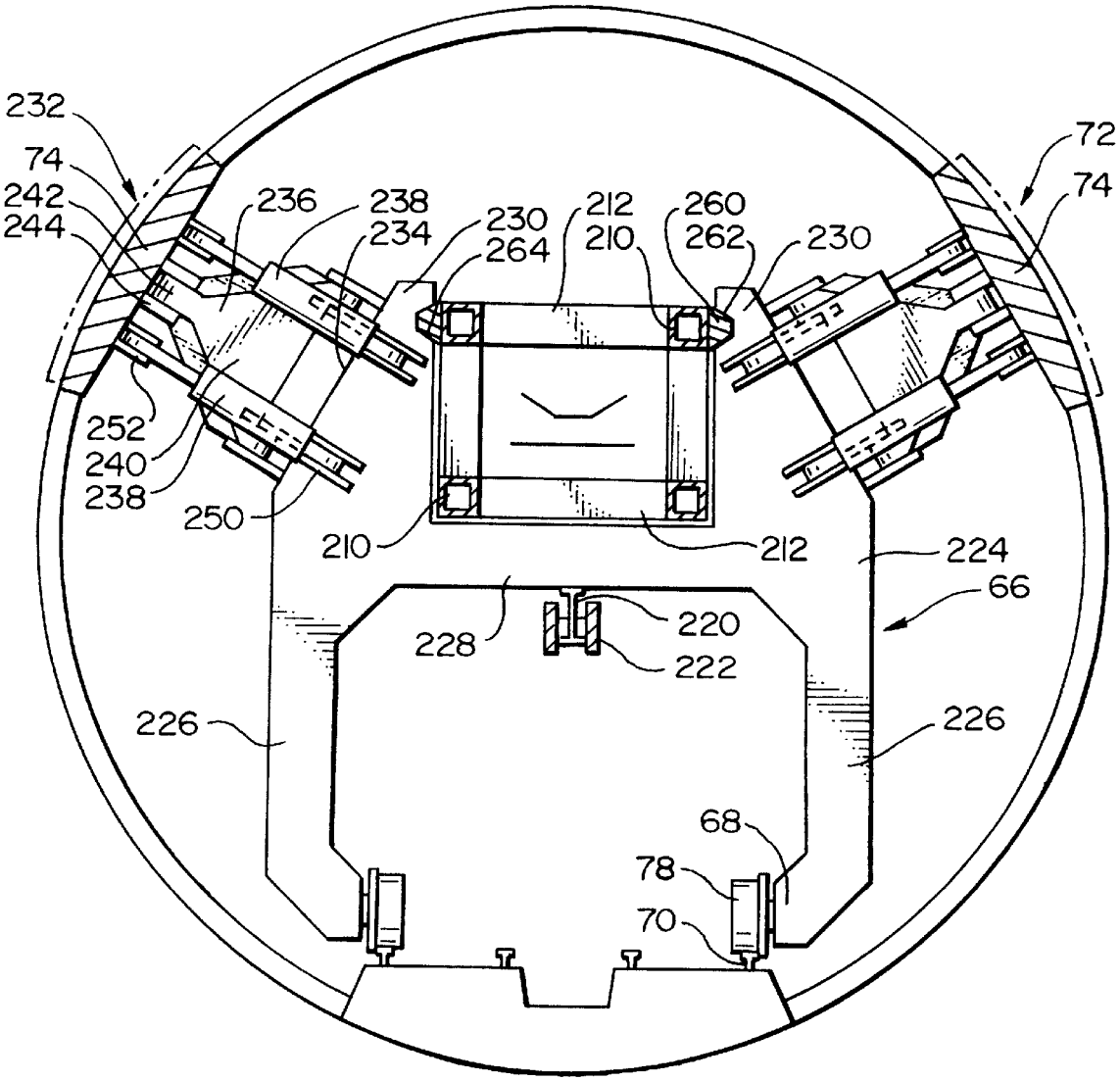
FIG. 7 is a cross sectional view taken at line 7—7 of FIG. 1B, illustrating the gantry and main beam of the present invention.

As can be seen in FIG. 7, the main beam structure has in cross section a rectangular configuration, comprising four longitudinal beams 210, interconnected in a rectangular configuration by cross beams 212, with these being reinforced by various diagonal braces 214. This main beam 60 performs a variety of functions. It supports the aforementioned conveyor 44 which extends through the beam and terminates at 216 a short distance behind the rear end 218 of the beam 60. Also, the beam 60 supports the operator's station, the transformer, electric cabinets 219, the hydraulic components and other subsystems. Suspended below the beam 60 and extending longitudinally is a mono-rail 220, to which is mounted a monorail hoist 222. Then there are the load bearing and other functions provided by the beam 60 in the overall operation of the present invention.

As seen in FIG. 7, the gantry 66 comprises an "H" shaped housing 224 comprising a pair of laterally spaced downwardly extending legs 226, joined at their upper ends by a cross member 228, and there are two laterally spaced upstanding upper leg portions 230 positioned on opposite sides of the main beam 60. The wheels 78 are mounted to the lower ends of the legs 226, and the aforementioned bearing and locating means 72 with the bearing pads 74, is mounted to the two upper leg portions 230.

There are two bearing pad mechanisms 232, each having one of the bearing pads 74 which are each supported from a related base plate 234 that is mounted to its related upper leg portion 230. Each bearing pad 74 is connected to its related base plate 234 through a single rigid link 236 and two positioning cylinders 238. As can best be seen in FIGS. 7, 8A and 8B, the single rigid link 236 has a triangularly shaped main body portion 240, with the apex part of the triangular body portion ending as a radially outward mounting stub 242 having a central through opening by which it is joined to a pair of ears 244 between which is positioned a connecting pin (not shown for ease of illustration).

The radially inward end of the link 236 has two laterally spaced mounting extensions 246, each of which is pivotally connected through a pair of ears 248 and a related pin to the base plate 234.

It can be seen that the radially inward mounting location at 248 is radially inward and forwardly of the location of the related bearing pad 74.

Each of the two mounting cylinders 238 is connected at its inner radially inward end to a pair of ears 250 connected to the plate 234, with the outer rod end of each cylinder 238 having a similar pivot connection at 252 to the pad 74. The two positioning cylinders 238 for each bearing pad mechanism 72 are aligned to be substantially perpendicular to the longitudinal axis 16. Thus, the outward force exerted by each cylinder 238 is perpendicular to the tunnel side wall. Each link 236 with the two cylinders 238 are thus able to position the related bearing pad 74 at a fixed location relative to the gantry housing 224.

Extending forwardly from the gantry housing 224 are two gantry positioning cylinders 254, positioned on opposite sides of the main beam 60. Each cylinder has a rear connecting pivot location at 256 to the gantry housing 224, and a forward pivot connection at 258 to the main beam 60.

Figure 8A:
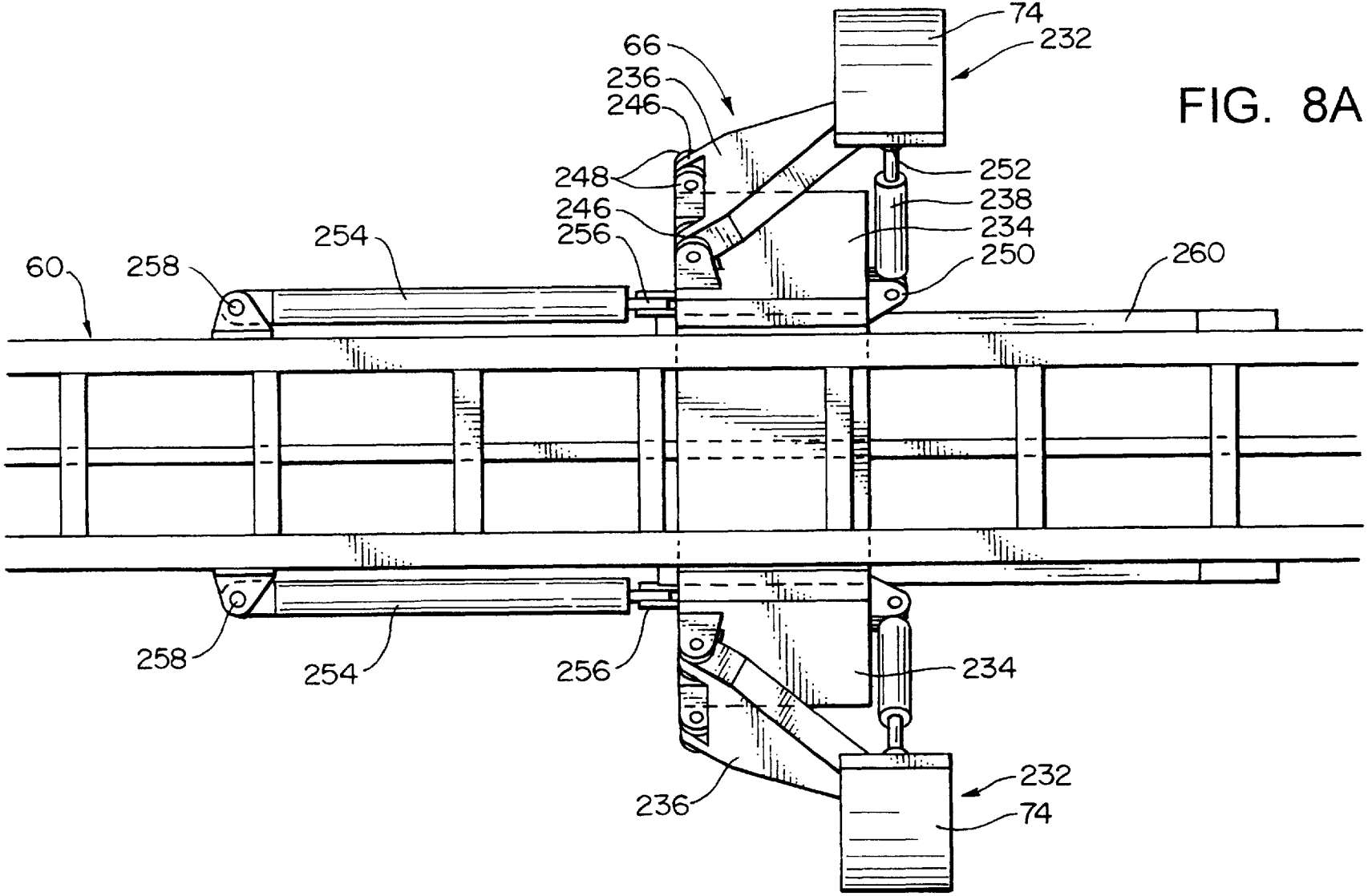
FIGS. 8A and 8B are horizontal sectional views taken along line 8—8 of FIG. 1B, looking down on the gantry and main beam of the present invention.
Figure 8B:
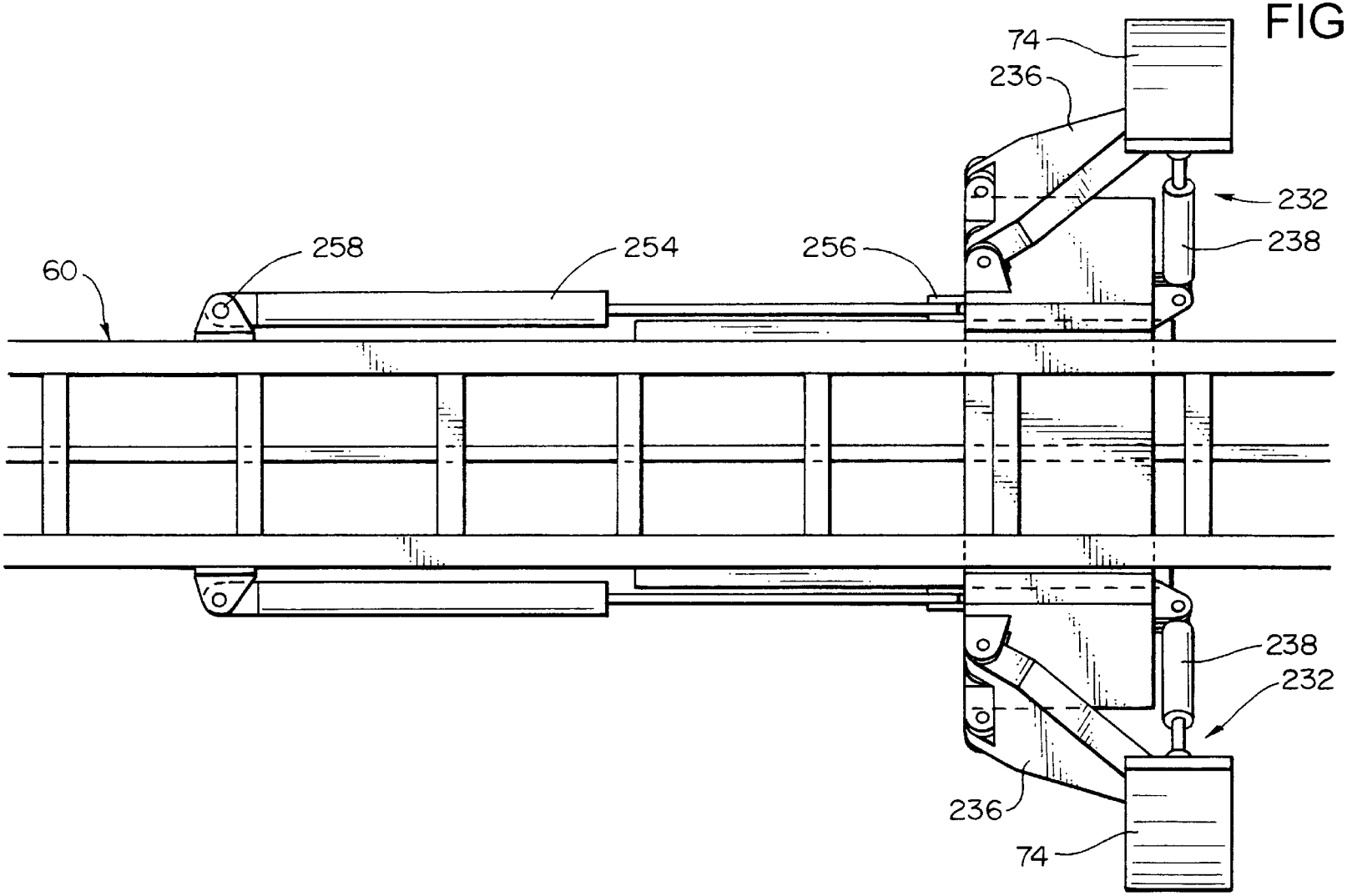

In FIG. 8A, the two gantry positioning cylinders are shown in their fully retracted position, so that the gantry 66 is at its most forward position relative to the main beam 60. In FIG. 8B, the two cylinders 254 are shown in their fully extended position, so that the gantry 66 is at its furthest rearward position, relative to the main beam 60.

To provide for slide engagement of the gantry housing 224 and the main beam 60, and also to properly transmit force loads therebetween, attached to the outwardly facing side surface of each of the upper two longitudinal beams 212 is a slideway member 260 which in cross sectional configuration has a trapezoidal shape, with its two converging side surfaces 262 extending toward one another in a laterally outward direction (See FIG. 7). The two upper side housing sections 230 each have a matching elongate groove 264, having a cross section matching the related slideway member 260, to receive the related slideway member 260 in a close fitting slide relationship. Each slideway member 260 extends along the beam 60 a sufficient distance to maintain engagement with the gantry housing 224 throughout the entire length of travel of the gantry 66 relative to the beam 60.

In the usual mode of operation when the machine 10 is advancing in the tunnel as the head 26 is boring through the ground strata, the two gripper shoes 74 would be in engagement with the tunnel side wall to stabilize the position of the beam 30. During this time, the two positioning cylinders 254 would be in a float condition so that the beam 30 is free to advance as the boring operation continues. When the machine has advanced a certain length (e.g. three meters or so), then the pad mechanisms 232 would be retracted, and the cylinders 254 retracted to advance the gantry 66 to a more forward location.

Also, in certain modes of operation, the cylinders 254 would be used to cause the forward or rearward movement of the machine 10 in the tunnel, in which case the pads 74 would be pressed outwardly with sufficient force to be able to react the loads imposed thereon into the tunnel wall. To comment on these load bearing functions briefly, it can be seen that the slide interconnection between the main beam 60 and the gantry housing 224, along with the action (or locking) of the positioning cylinders 154, as needed causes the vertical, lateral, longitudinal and torsional loads to be transmitted from the beam 60 into the gantry housing 224. With the two bearing pads 74 pressing against the tunnel wall, and with the wheels 78 in engagement with the rail 70, such vertical, lateral, longitudinal and torsional loads are in turn transmitted into the tunnel wall.

a. The Positioning and Roll Control Mechanism 24

This will be described with reference to FIGS. 1A, 3, and 9 through 12. Earlier in this text, it was indicated that there were four positioning cylinders 80 interconnecting the front of the main beam 60 with the support structure 36, and also two roll control cylinders 82.

Figure 9:
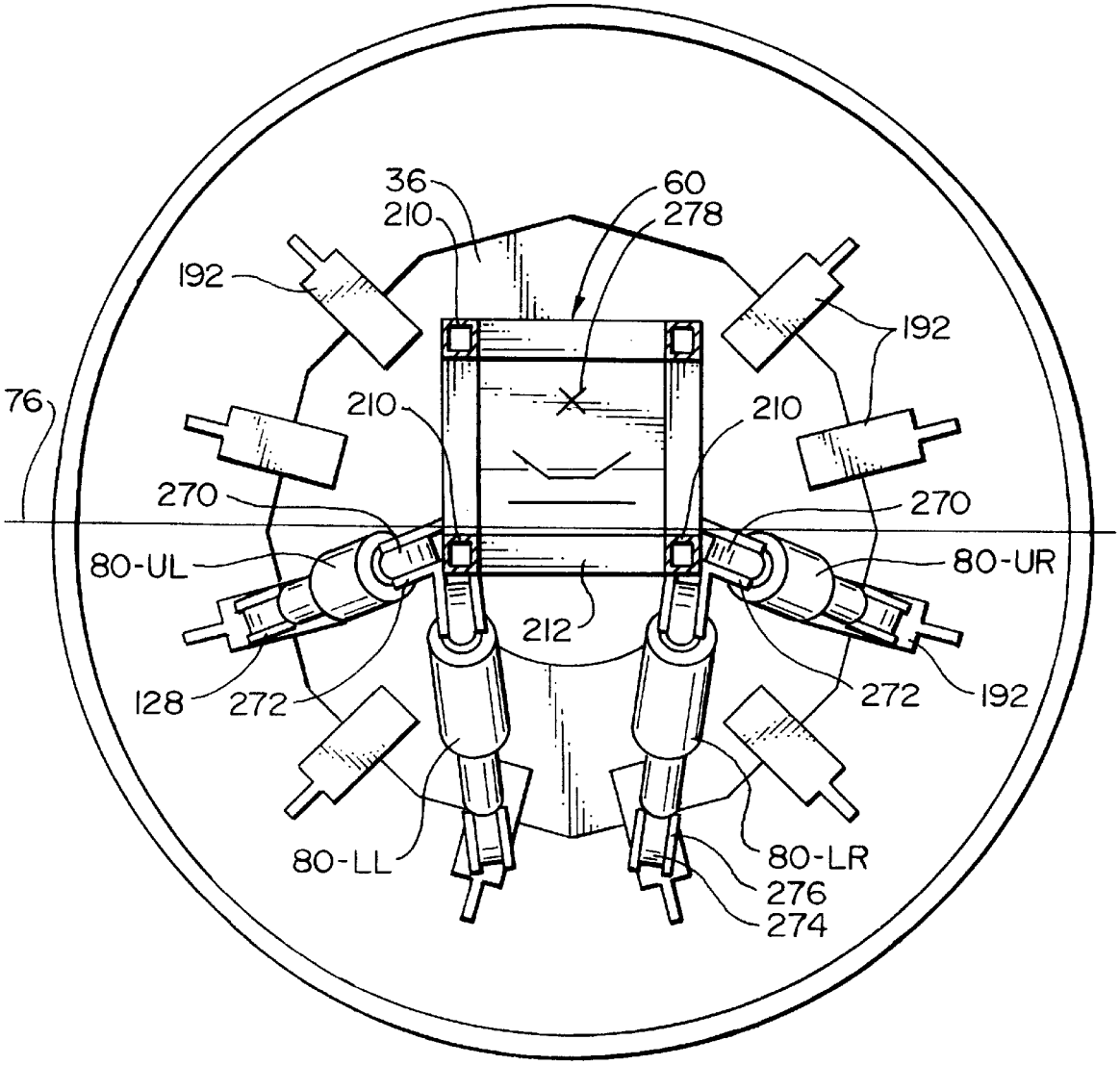
FIG. 9 is a somewhat simplified cross sectional view taken at line 9—9 of FIG. 1A, illustrating the head positioning mechanism of the present invention.

To describe the positioning cylinders 80 in more detail, reference is made initially to FIG. 9, which for convenience and clarity of explanation, is a simplified drawing, leaving out many components, and which is taken at location of 9—9 of FIG. 1A. It can be seen by comparing FIG. 9 with FIG. 3 that most of the components located in the machine forwardly of the section line 3—3 have been omitted in FIG. 9, and only the rear support section 36 and the mounting fittings 192 for the propel cylinders 182 and the cylinders 168 are shown.

For purposes of description, in FIG. 9, the four positioning cylinders 80 will have additional designations relative to their positions, as shown in FIG. 9. Thus, there is the cylinder 80-UR which is at an upper right location, cylinder 80-LR at a lower right location, cylinder 80-LL at a lower left location and finally cylinder 80-UL at an upper left position. Each of these cylinders 80 have a rear pivot connecting end at 270 which connects to a related pair of ears 272 at the front lower end of the related lower longitudinal beam 210.

The front end of each cylinder 80 has a pivot connection to a related one of the mounting members 192 which are fixedly connected to the rear structure section 36. The two lower cylinders 80-LR and 80-LL connect to the two lowermost connecting members 192 that are at the lowermost portion of the structure 36. The two cylinders 80-UR and 80-UL connect to the two connecting members 192 that are immediately below the spring line 76 (i.e. the lateral center line of the machine 10 and also of the tunnel).

The front pivot connection of each of the cylinders 80 is designated at 274, and the ears connected to the related mounting member 192 to which the connection 274 are made are indicated at 276. It can be seen in FIG. 1A that the forward bearing connection 64 of the beam 60 to the structure section 36 is at a location above the two forward connections 274 of the two upwardly positioned cylinders 80-UR and 80-UL. The location of the center of the bearing 64 is indicated by an "X" at 278 in FIG. 9.

Thus, it can be seen from observing FIG. 9 that the forward part of the main beam 60 makes a connection with the rear support structure 36 at five different locations, with four of these locations being at the front ends of the four cylinders 80, and the fifth connection being at the universal bearing location 64.

Figure 10A:
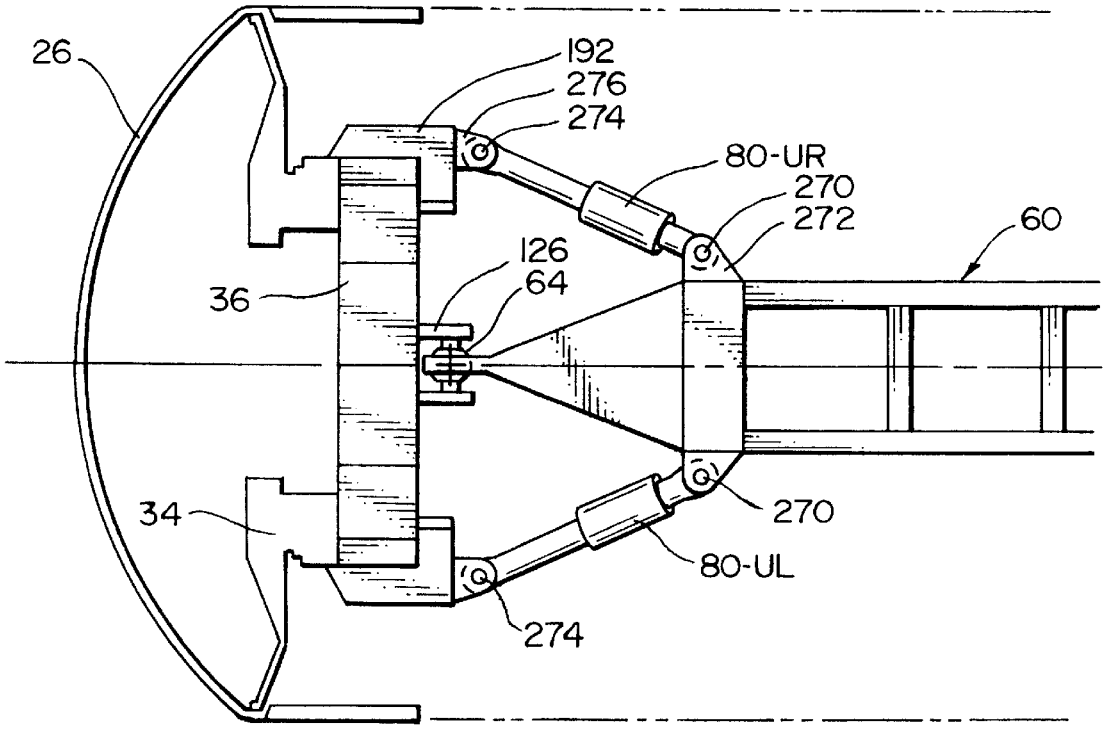
FIGS. 10A and 10B are horizontal sectional views, showing in a simplified form, the upper positioning cylinders of the present invention.
Figure 10B:
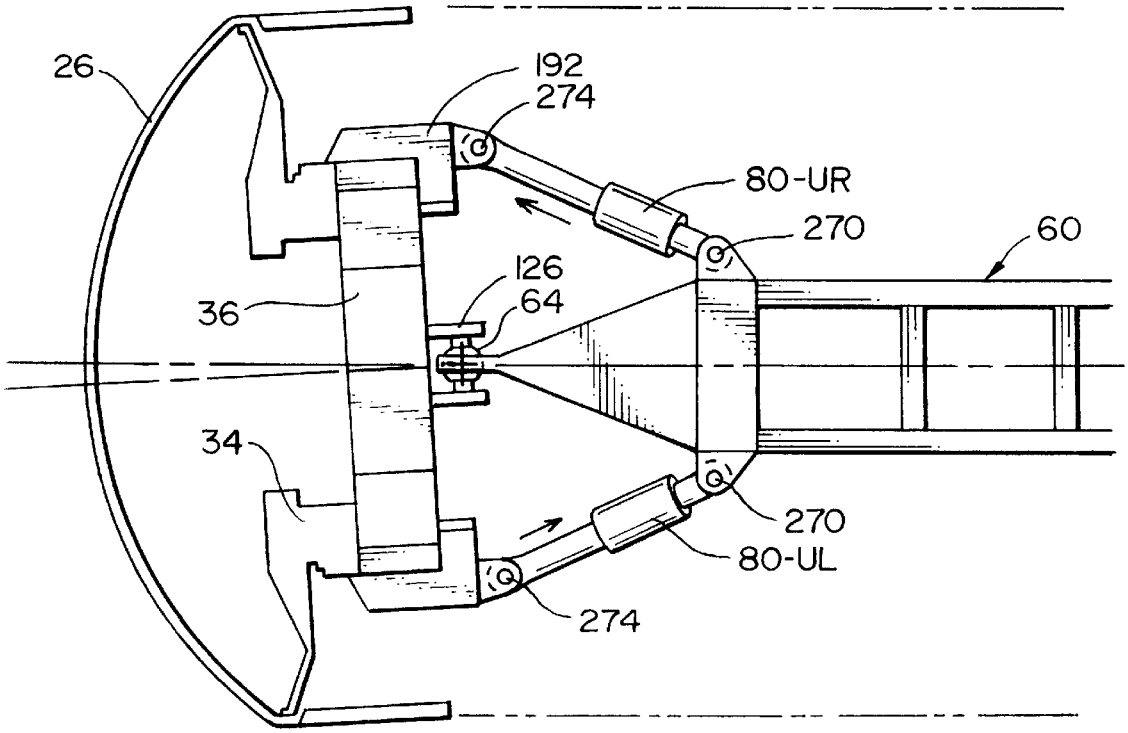

It is evident in viewing this arrangement of the four cylinders 80 and the bearing connection at 64 that the cylinders 80 can be extended or retracted so as to adapt to, or change, the angular orientation of the cutting head 84 relative to main beam 60 about any transverse axis extending through the pivot location at the bearing 64. Thus, with reference to FIGS. 10A and 10B, in 10A the cutterhead 26 is shown so that its center line is in alignment with the longitudinal axis 16. As shown in FIG. 10B, it can be seen that by extending the upper right cylinder 80-UR, and retracting the upper left cylinder 80-UL, the cutterhead 26 can be made to change its direction about a vertical transverse axis toward the left. It should be understood, that since the two lower cylinders 80-LR and 80-LL also connect to the support section 36 at laterally spaced locations, that these also will be extended and retracted in a manner similar to what is shown in FIG. 10B to enable the alignment of the cutterhead 26 to be accomplished, as indicated in FIG. 10B.

Figure 11:
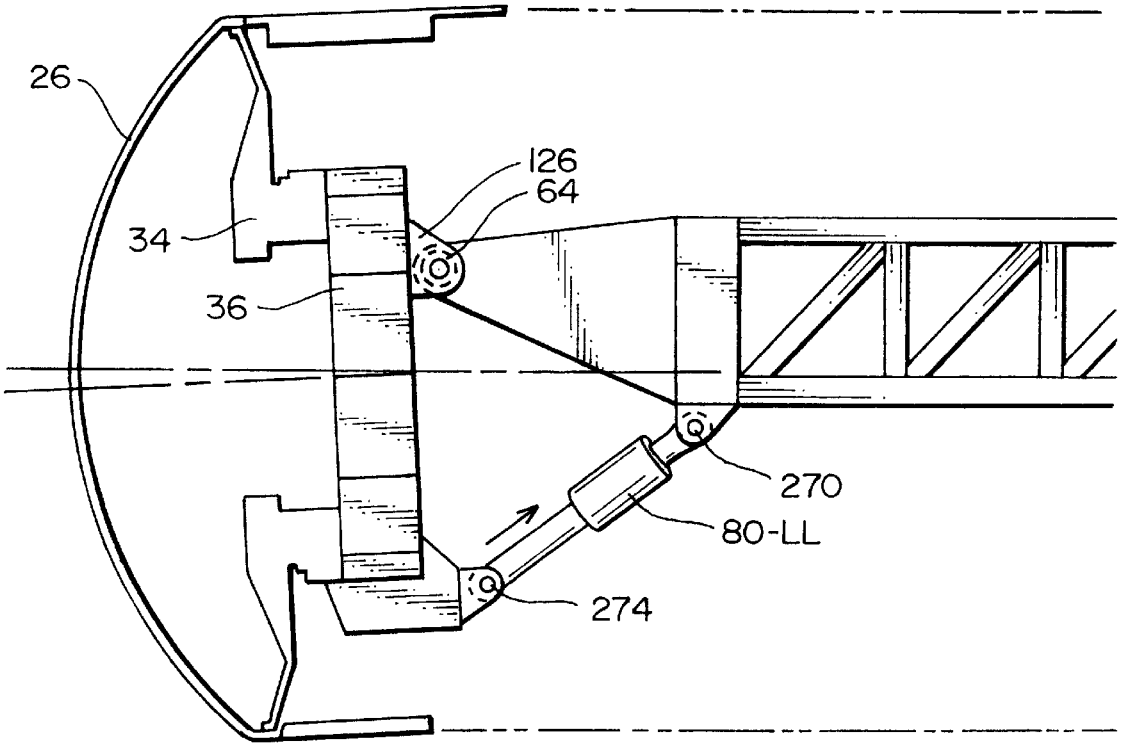
FIG. 11 is a side elevational view, partly in section, showing in a simplified form the two lower positioning cylinders of the present invention.

FIG. 11 is a somewhat simplified side elevational view showing the lower left cylinder 80-LL. As shown in FIG. 11, the cylinder 80-LL is being retracted, and let us assume that the lower right hand cylinder 80-LR is being retracted by the same amount as the left lower cylinder 80-LL. In this instance, the cutting head 26 will be rotated about a transverse horizontal axis to face in a downward direction. Again, since the upper cylinders 80-UR and 80-UL are positioned below the bearing connection 64, these upper cylinders 80-UR and 80-UL will also have to be retracted a certain amount to properly accomplish the relative rotation of the head 26. Extending these cylinders will direct the cutterhead more upwardly.

From the above, it is also evident that the four positioning cylinders 80 can be extended and retracted in various combinations to rotate the cutterhead 26 about the bearing location 64 so that there is a combination of changing lateral orientation of the cutting head 26 facing more toward one side or the other, along with a change in vertical direction of orientation either upwardly or downwardly.

The positioning cylinders 80 itself could be used to change the position of the head section 18 by extending and retracting the cylinders in an appropriate pattern. However, as will be described later, it is contemplated that the alignment corrections would usually be made by modifying the flow rate of the hydraulic fluid to the propel cylinders 182. Thus, if the machine has gone off alignment toward the left, then the correction would be made by pumping more hydraulic fluid to the upper and lower left quadrants of propel cylinders 186 to extend these at a more rapid rate than the right quadrants of the propel cylinders 182. Also, if the misalignment is a result of the machine being orientated in a more upward or downward direction, then there would be the appropriate flow to the upper and lower quadrants of propel cylinders 186 to correct this misalignment. It is evident that by controlling the flow to the propel cylinders 186 in a selected pattern, the alignment change could be made in substantially any direction which would have both horizontal and vertical alignment components.

In the normal drilling mode, where the machine 10 is operating so as to be in proper alignment, usually all four of the positioning cylinders 80 would be locked. This would provide a redundant load path from the cutterhead 26 and the load bearing structure 32 to react eccentric loads on the cutterhead. For example, the cutterhead may be encountering a rock strata where at one portion the rock is highly resistant to cutting and another portion is much softer, this creating a torque which would tend to change the direction and orientation of the cutterhead 26.

With the position cylinders 80 locked in place, the torque on the cutterhead would be reacted back through the main beam 60, and with the positioning pads 74 of the gantry 66 pressing against the tunnel wall, these eccentric loads would be resisted and reacted into the tunnel wall. Also, the locking of the positioning cylinders 80 and roll control cylinders 82, in combination with the bearing connection 64, provides a redundant path in resisting torque loads imposed by the cutterhead 26 onto the support structure section 36.

Figure 12:
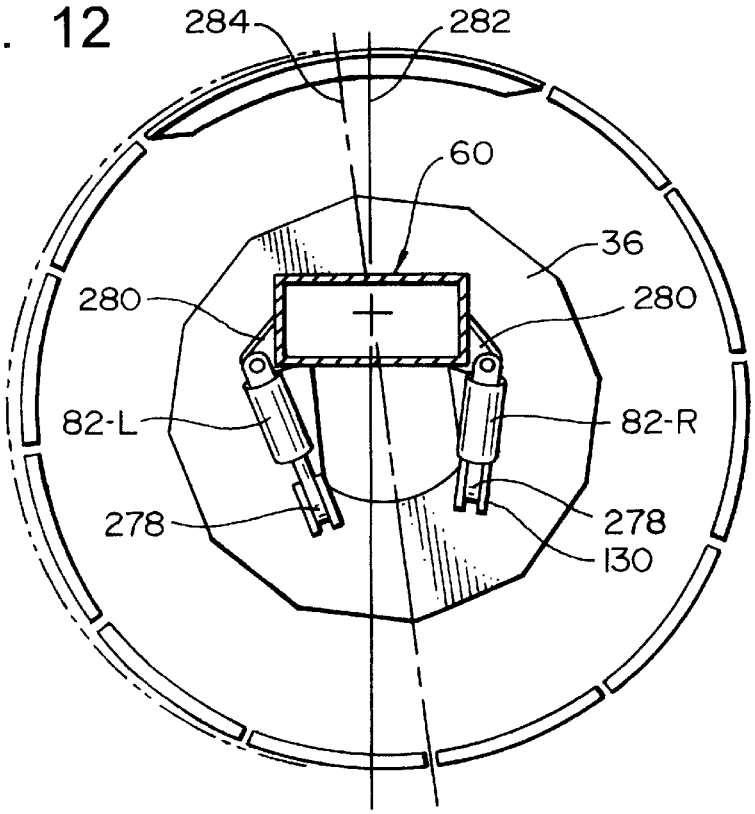
FIG. 12 is a sectional view taken approximately at the position of FIG. 3, illustrating the operation of the roll control cylinders of the present invention.

With regard to the operation of the cylinders 82 for the roll control the cylinders 82 would normally be utilized to correct the roll position as the machine 10 while the gripper shoes 36 are advancing in the tunnel 38. The gantry 66 would have its pads 74 pressing against the tunnel wall and as the gripper shoes 86 are being advanced, the roll cylinders 82 would be operated to exert a rotational force on the support structure 36. This is shown in FIG. 12 where the vertical orientation of the head section 18 is being moved from 284 to 282. It is important that the roll orientation of the head section 18 be maintained within rather precise limits, since the alignment control mechanisms of the machine 10 depend upon the proper roll orientation.

F. Overall Operation of the Present Invention

The overall operation will be described under appropriate headings. In the following description, it will be assumed that a machine 10 is boring a tunnel at a substantial depth beneath the ground surface.

1. Normal Tunneling Mode of Operation

Let us assume that the machine 10 is positioned in the tunnel 38, with the cutters of the cutterhead 26 being in engagement with the tunnel end wall 40, that the gripper shoes 86 and the two bottom support shoes 55 are in their forward positions as shown in FIGS. 6A and 1A, respectively, and that the roof shield is positioned as shown in FIG. 4A.

The gripper shoes 86 are pressed outwardly against the tunnel side wall with a sufficient force to maintain their stationary positions against the tunnel wall, as they react into the tunnel wall the thrust loads and torsional loads imparted to the cutterhead 26 through the support structure 32 (and specifically into the rear support section 36, and thence into the shoes 86. The lower support shoes 55 engage the tunnel invert 56 to precisely locate the front part of the machine 10 at the proper elevation relative to the invert 56. The roof shield 53 presses against the tunnel crown 52 to resist downward movement of the crown of the tunnel immediately rearwardly of the perimeter 30 of the cutterhead 36.

The electric motors 108 are operated to act through the pinion gears 104 and the ring gear 102 to cause the cutterhead 26 to rotate. At the same time the propel cylinders 182 of all of the shoe mechanisms 58 (or some of the propel cylinders 182 for at least one mode of operation) are retracted to cause the machine 10 to advance. (The various modes of operation of the gripper shoe mechanism 58 will be described in the following subsection.)

As described previously the rock fragments that are dislodged from the tunnel surface 40 are picked up by the scoop mechanism of the cutterhead 26 to be deposited into the hopper 42 to be deposited on a conveyor 44 to be carried to the rear end 14 of the machine and be carried away in a suitable manner.

During the normal operating mode, the four positioning cylinders 80 and also the roll cylinders 82 are locked in place. Also, the two support pads 74 of the gantry 66 (see FIG. 7) are pushed outwardly against the tunnel side wall to stabilize the gantry 66 and the main beam 60 relative to the tunnel wall and also to enable the main beam 60 and the gantry 66 to react certain forces into the tunnel wall.

As the machine 10 advances during the boring operation, the lower support shoes 55 remain stationary, relative to the tunnel invert 56. At the same time (with the machine 10 moving forwardly), the circularly curved bearing surface 174 of each support link 166, being in engagement with the downwardly facing bearing surface 176 of the structure 136, maintains the support structure 36 to be positioned at a precisely controlled elevation above the tunnel invert 56. With regard to the roof shield mechanism 46, the positioning cylinders 156 are pressurized to a level to maintain the force exerted by the roof member 53 against the tunnel crown 52 at the desired level. Due to the action of the parallogram strut support assembly 140, the roof member 53 remains substantially parallel to the longitudinal axis 16. If the boring operation is taking place at very deep elevations in the earth's strata, where the surrounding ground or rock strata pressures are expected to be rather high, the upward force exerted by the roof shield member 53 could be rather substantial. With the machine 10 moving forwardly in the tunnel as the boring operation continues, the upper surface of the roof shield member 53 slides against the tunnel crown 52.

As the machine advances, the support rings 88 are moved into position within the tail portion 136 of the roof shield member 53 and also closely behind the gripper shoes 86 and the support shoes 55. After the machine 10 has moved a sufficient distance forward, then the most forward support ring 86 is expanded to be in supporting contact with the tunnel side wall, and further reinforcing structure is put into place, as described previously herein.

2. Operation of the Gripper Shoe Assembly 50

As indicated previously, there are at least three operating modes by which the gripper shoe mechanisms 58 can advance the machine 10. In two of these operating modes, the advance of the machine is interrupted while the gripper shoes 86 are advanced. In the third mode, the advance of the machine is continuous. The operating mode which is selected will depend upon various factors, such as the character of the ground strata through which the tunnel is being bored.

The first operating mode is accomplished as follows. With reference to FIG. 6A, let us begin with all of the shoes being positioned at the forward location, as illustrated in 6A, and the support shoes 55 also in their forward position. The gripper cylinders 180 are pressing the shoes 86 outwardly against the tunnel wall. If the machine 10 is operating at a substantial depth beneath the ground surface, then the bearing pressure against the side wall would quite possibly be greater than the pressure which would be required simply to be able to react the loads from the cutterhead 26 into the tunnel side wall.

In this first mode, the advance of the machine is accomplished by retracting all of the propel cylinders 182 simultaneously so that the gripper shoes 86 remain stationary against the tunnel wall, and the machine 10 is moved forwardly. During this time, the bottom support shoes 55 also remain stationary with the tunnel wall. Again, on the assumption that the machine 10 is operating at a substantial depth, the upward force exerted by the roof shield 53 may be substantial, and these vertical loads would be reacted through the shoes 55 into the surface of the tunnel invert 56. Also, as described previously, the roof shield 53 moves with the machine 10 as the roof shield 53 slides against the tunnel crown 52.

The stroke of the propel cylinders 182 will depend upon the requirements for providing lateral support against the side walls of the tunnel converging immediately after the cutterhead forms that section of the tunnel wall. It is presently contemplated that for a large machine 10 having a cutter diameter as great as thirty feet, the maximum stroke of the gripper shoes 86 would be as great as one half a meter (0.5 m).

After the propel cylinders 182 have been fully retracted to complete this increment of advance of the machine 10, then two pair of oppositely positioned shoes 86 will remain gripping the tunnel side wall, while the radial thrust pressure exerted by the gripper cylinder links 180 is lowered for the other four shoes. However, it is expected that enough pressure is maintained in these cylinder links 180 so that there is some radial force exerted by the non-gripping shoes 86. The four non-gripping shoes 86 are advanced by extending their related propel cylinders 182, as the other four gripper shoes 86 remain in firm contact with the tunnel side wall.

After the advance of the non-gripping shoes 86, their related cylinder links 180 are pressurized to a higher level to cause these to firmly grip the tunnel side wall, and the rearwardly positioned shoes 186 have the pressure in their cylinder links reduced, after which these rearwardly positioned gripper cylinders are advanced, again with sufficient pressure in their gripper cylinders 180 to provide some support against the tunnel wall. Under certain conditions, it might be practical to substantially totally release the gripper shoes 86 which are being moved forwardly from any significant force exerted against the tunnel side wall.

When all eight gripper shoes 86 have been advanced, then these are all pressed outwardly against the tunnel side wall, and all of the propel cylinders 182 are retracted to cause the machine 10 to again advance in the tunnel.

During the time period that the gripper shoes 86 are being advanced and the machine 10 is not traveling forwardly, the two support shoes 55 would be advanced by extending the related cylinders 168. The support shoes 55 would desirably be advanced at a time when the vertical position of the forward part of the machine is fixed, such as having at least some (or all) of the gripper shoes 86 in firm engagement with the side wall of the tunnel.

Since the cutterhead advances away from the stationary shield formed by the gripper shoes, even shorter increments (i.e. less than 0.5 meters) may be required in unstable ground, although the roof shield does advance with the cutterhead.

Since the gripper shoes 36 are also utilized to support the ground, the force required to cycle the shoes forward is relatively high. As a result, only half of the shoes are advanced at a time, and the other half are in the grip mode providing the necessary reactive force. The assumed ground pressure on the shoes during advancement is 200 $kN/m^2$.

Considering the advance increment of the rear gantry is 3000 mm, and the boring increment is 500 mm, the advance cycle consists of:

(6) boring advances (12 gripper shoe advances (1) rear gantry advance

As an example, let's assume the cutterhead speed is 5.4 rpm. Assuming a boring rate of 9 mm per revolution, each boring advance takes 10.3 minutes. Each gripper shoe advance takes 0.5 minutes, and the 3 m gantry advance takes 2.0 minutes. Time to advance 3 m is 69.8 minutes or an advance rate of 2.58 meter per hour.

The second mode of operation is similar to the first mode of operation, described immediately above, in that with the gripper shoes 86 in the forward position as shown in FIG. 6A, all eight of the propel cylinders 182 are retracted to advance the machine 10 by a selected increment of travel. However, at the completion of the forward increment of travel, instead of advancing only two pair of oppositely positioned gripper shoes 86 (with the other four gripper shoes remaining in gripping contact with the tunnel wall at a stationary position), all eight of the gripper shoes 86 are advanced simultaneously. To advance the shoes in the second mode of operation, the gripper pads 74 of the gantry 66 would be pressed firmly against the tunnel side wall to react the thrust loads (and possibly other loads) which would be encountered by advancing all of the gripper shoes 86 simultaneously. To accomplish the simultaneous forward advance of all eight gripper shoes 86, the pressure in the gripper cylinders 180 would be reduced to a sufficiently low level. This second mode of operation would be used in the circumstances where there is no significant convergence of the tunnel side wall.

The third mode of operation is, as indicated above, the continuous mode. In general, in this third mode of operation, two pairs of oppositely positioned gripper shoes 86 are always firmly gripping the side wall, while the machine is advancing forwardly, and at the same time the other two pairs of oppositely positioned shoes 86 are being moved forwardly to a position to firmly engage the tunnel side wall at such time as the propel cylinders 182 of the gripper shoes 86 engaging the side wall have completed their propel stroke. Then the set of two pair of gripper shoes 86 which have been moving forwardly are now pressed outwardly with a higher pressure, while at the same time the pressure against the tunnel side wall of the gripper shoes which have been in firm engagement is reduced, with these gripper shoes which have been in firm engagement now traveling forwardly.

To relate this to the positions shown in FIGS. 6A and 6B, we will assume that the first set of shoes 86 (comprising two pair of oppositely positioned gripping shoes 86) is positioned forwardly as shown in FIG. 6A, while the second set of shoes 86 are in a rearward position of FIG. 6B. The pressure in the gripping cylinders 180 of the first set of shoes (FIG. 6A) is at a higher level so that the gripper shoes 86 in FIG. 6A firmly engage the side wall of the tunnel. With regard to the second set of gripper shoes 86 (in FIG. 6B) these have just completed their forward propel function, and their gripping cylinders 180 would now have their operating pressure reduced substantially.

To cause the machine to continue on the continuous forward path of travel, the propel cylinders of 182 of the first set of FIG. 6A are now started to be retracted (with their related shoes 86 firmly gripping the tunnel side wall), while the propel cylinders 182 of the other set of shoes (shown in FIG. 6B) are being extended. Thus, the shoes 86 of the second set of FIG. 6B are traveling forwardly at twice the rate of forward travel of the machine 10. At such time as this increment of travel is completed, the second set of shoes 86 in FIG. 6B have reached the forward position of FIG. 6A, while the shoes 86 of the first set have reached the rear position of FIG. 6B. Then the sequence is repeated.

3. Directional Control and Roll Control

These operations will be described mainly with reference to FIGS. 9 through 12.

As discussed previously, it is contemplated that the changes and/or corrections relative to direction and roll will be made while the machine 10 is advancing in the tunnel. Generally, (as is disclosed above) during the normal tunnel boring operation, the positioning cylinders 80 and the roll control cylinders 82 would be in a locking mode so as to provide a redundant load path from the head section 16 into the beam 60 and gantry 66.

Consideration will first be given to the changes in direction of the head section 18. The correction will normally be made by directing greater fluid flow to the propel cylinders 182 of two of the quadrants of gripper shoe mechanisms 58, and less flow to the propel cylinders 182 of the opposite quadrants of gripper mechanisms 58, thus causing one part of the head section 18 to travel forwardly at a more rapid rate than the opposite part. During this time, the four positioning cylinders 80 would be in a float condition. When the proper correction in the direction of the head section 18 is completed, then the four positioning cylinders would then placed back in the lock mode for the normal tunneling operation.

Another possibility is that the directional control could be accomplished by extending and retracting the cylinders 80 in a predetermined manner to obtain the desired change in direction. This could be accomplished, for example, while the machine 10 is stationary in the tunnel, and the gripper shoes 86 exerting possibly a lower pressure against the tunnel side wall. In this mode of operation, the beam 60 would be reacting the torque loads (and possibly other loads) through the gantry 66 into the tunnel side wall, with the positioning pads 74 of the gantry 66 being pressed against the tunnel side wall. Therefore, the positioning cylinders 254 for the gantry 66 would be in a lock position, or conceivably could be extended forwardly or rearwardly, as needed, depending upon precisely how the repositioning of the cutterhead 18 is being accomplished.

As indicated previously, roll control would normally be accomplished while the gripper shoes 86 are advancing in the tunnel. When the roll control is being accomplished, the positioning shoes or pads 74 of the gantry 66 would be pressing against the tunnel side wall.

As the gripper shoes 86 are advancing in the tunnel in its regrip mode of operation, the roll control cylinders 82 are operated as shown in FIG. 12, with one cylinder 82-L or 82-R being extended, and the other being retracted. This will exert a torque load into the support structure 36.

During this period of roll correction, the torque loads from the head section 18 would be transmitted into the main beam 60 to the gantry 66 and into the tunnel wall.

Various modifications could be made without departing from the teachings of the present. For example, the specific dimensions, number of components, specific relative locations, configuration and other items could be varied without departing from the basic teachings of the present invention. Also, while cylinders are shown as means for propelling, positioning, and in general exerting compression and tension forces, within the broader scope of the present invention other actuating devices could be employed to serve such functions and also to provide force moments to perform various functions of the present invention.

Therefore, I claim:

1. A tunnel boring machine adapted to bore a tunnel into a ground strata, said machine having a front end, a rear end, and a longitudinal axis, said machine comprising:

a. a forward positioned head section, comprising:

i. a cutter head having a forward cutting face and a perimeter portion, and being mounted in said head section for rotation about the longitudinal axis;

ii. a support structure to which said cutting head is rotatably mounted in a manner that torque and thrust loads from said cutter head are reacted into said support structure;

b. a gripper and propel assembly comprising:

i. a plurality of gripper shoes positioned at circumferentially spaced locations adjacent to, and rearwardly of, the perimeter portion of the cutter head;

ii. a plurality of gripper and propel actuating mechanisms operatively connected between said gripper shoes and said support structure to exert both radial and longitudinal force components from said support structure to said gripper shoes to press said gripper shoes into gripping tunnel wall engagement and cause longitudinal travel of said shoes relative to said support structure to advance said support structure with the cutter head while reacting loads from the cutter head to the support structure, through the gripper and propel actuating mechanisms, and through the gripper shoes into adjacent ground strata.

2. The machine as recited in claim 1, further comprising a beam assembly comprising:

a. an elongate longitudinally aligned beam structure having a forward end connected to said support structure and extending rearwardly therefrom;

b. a gantry means operatively connected to said beam structure rearwardly of said support structure and having tunnel engaging pad means to locate said beam structure relative to said support structure.

3. The machine as recited in claim 2, further comprising positioning means operatively connected between said support structure and said beam structure to cause relative rotation between said support structure and said beam structure about axes transverse to said longitudinal axis for vertical and lateral alignment and positioning adjustment.

4. The machine as recited in claim 3, wherein said positioning means comprises a plurality of positioning cylinders laterally and vertically spaced from one another and interconnected between said beam structure and said support structure, whereby extending and retraction said positioning cylinders selectively causes said relative rotation of said support structure relative to said beam structure.

5. The machine as recited in claim 4, where said positioning means further comprises roll control cylinder means operatively connected to said beam structure and said support structure to cause rotation of said support structure relative to said beam structure about said longitudinal axis, to properly position said support structure relative to roll orientation.

6. The machine as recited in claim 2, wherein there is positioning means operatively connected between said beam structure and said support structure, to cause relative rotation of said support structure relative to said beam structure about said longitudinal axis, to orient said support structure to said beam structure relative to roll.

7. The machine as recited in claim 6, wherein said positioning means comprises cylinder means spaced laterally from said longitudinal axis, and aligned to exert rotational force components between said beam structure and said support structure.

8. The machine as recited in claim 2, wherein said beam structure has at its forward end a universal connection to said support structure to permit rotation of said support structure, relative to said beam structure, about axes perpendicular to said longitudinal axis, for alignment and correction of alignment of said support structure both vertically and laterally, said machine further comprising positioning means to cause said relative rotation.

9. The machine as recited in claim 8, wherein said positioning means comprises a plurality of positioning cylinder means operatively connected between said beam structure and said support structure at vertically and laterally spaced locations to position said support structure relative to said beam structure.

10. The machine as recited in claim 9, further comprising cylinder means operatively connected between said beam structure and said support structure for rotating said support structure relative to said beam structure about said longitudinal axis for positioning said support structure relative to roll orientation.

11. The machine as recited in claim 1, further comprising support shoe mechanism means positioned below said support structure and in operative engagement therewith, said support shoe means comprising tunnel invert engaging shoe means and link means positioned between said shoe means and said support structure to permit relative longitudinal movement between said support shoe means and said support structure while maintaining substantially constant vertical spacing therebetween.

12. The claim as recited in claim 11, wherein said link means is pivotally mounted for rotational movement, said link means further comprising bearing surface means having a curved bearing surface relative to a pivot mounting location of said link means to provide said constant vertical spacing.

13. The machine as recited in claim 11, wherein said link means is pivotally connected to said support shoe means for rotation about a pivot location, and extends upwardly from said pivot location, said link means have an upwardly facing bearing surface curved circularly about said pivot location, said bearing surface engaging a matching bearing surface of said support structure so as to be in rolling contact therewith and thus provide said constant vertical spacing.

14. The machine as recited in claim 13, wherein said support shoe mechanism means further comprises shoe actuating means to move said support shoe means longitudinally relative to said support structure.

15. The machine as recited in claim 11, wherein said support shoe mechanism means further comprises shoe actuating means to move said support shoe means longitudinally relative to said support structure.

16. The machine as recited in claim 1, wherein said gripper shoes are located in two sets spaced laterally from one another on opposite sides of said support structure, said machine further comprising a roof shield mechanism positioned above said support structure adjacent to, and rearwardly of, an upper perimeter portion of said cutter head, said roof shield mechanism comprising a tunnel crown engaging plate means, and force transmitting means positioned operatively between said support structure and said plate support means to press said plate support means upwardly into tunnel crown engagement.

17. The apparatus as recited in claim 16, wherein said roof shield mechanism means comprises a parallel linkage interconnecting said support structure and said plate support means, whereby said plate support means can be moved with an upward and downward component of travel while maintaining parallel alignment.

18. The machine as recited in claim 17, wherein said roof shield mechanism comprises cylinder means operatively engaged between said support structure and said crown engaging plate means to cause movement of said plate support means relative to said parallel linkage.

19. The machine as recited in claim 1, wherein said support structure has a ring-like configuration with a load bearing section positioned radially inwardly of said plurality of gripper shoes, with load bearing portions of said load bearing section being in substantial transverse alignment with load bearing portions of said gripper shoes.

20. The machine as recited in claim 19 wherein each of said gripper and propel mechanisms is operatively connected to a related one of said gripper shoes, each of said gripper and propel mechanisms comprising cylinder link means connected between said load bearing section and related gripper shoes and positioned to exert radially outward forces from said load bearing section to said gripper shoes.

21. The machine as recited in claim 20, wherein each of said gripper and propel mechanisms comprises propel cylinder means operably connected between its related gripper shoe and said load bearing section, each of said propel cylinder means having a substantial longitudinal alignment component to move said gripper shoes longitudinally.

22. The machine as recited in claim 1, wherein a. said gripper shoes are located in two sets spaced laterally from one another on opposite sides of said support structure;

b. there is a support shoe mechanism means positioned below said support structure and in operative engagement therewith, said support shoe means comprising tunnel invert engaging shoe means and link means positioned between said shoe means and said support structure to permit relative longitudinal movement between said support shoe means and said support structure while maintaining substantial constant vertical spacing therebetween.

23. The machine as recited in claim 22, wherein said support structure has two oppositely positioned side load bearing portions, an upper load bearing portion, and a lower load bearing portion, said load bearing portions of said support structure being substantially radially aligned with load bearing portions of said gripper shoes and said support shoe means, respectively, whereby radial loads imparted to said gripper shoes and said support shoe means are reacted into said support structure radially with a substantial radially inward force component.

24. The machine as recited in claim 23, further comprising a roof shield mechanism positioned between said sets of gripper shoes and above said support structure, said roof shield mechanism comprising a tunnel crown engaging plate means, and force transmitting means positioned operatively between an upper load bearing portion of said support structure and said plate support means to press said plate support means upwardly into tunnel inverting engagement, said plate means having a load bearing portion in substantial transverse alignment with the upper bearing portion of said support structure.

25. The machine as recited in claim 24, wherein the side, upper and lower portions of said support structure define a center longitudinal through opening from said head section rearwardly to a location rearwardly of said support structure, said support structure being arranged so that thrust and torsional loads from said cutter head are imparted into said support structure and thence radially outwardly through said gripper and propel assembly into surrounding earth strata.

26. The machine as recited in claim 1, wherein, said machine further comprising a roof shield mechanism positioned above said support structure adjacent to, and rearwardly of, an upper perimeter portion of said cutter head, said roof shield mechanism comprising a tunnel crown engaging plate means, and force transmitting means positioned operatively between said support structure and said plate support means to press said plate support means upwardly into tunnel crown engagement.

27. The apparatus as recited in claim 26, wherein said roof shield mechanism means comprises a parallel linkage interconnecting said support structure and said plate support means, whereby said plate support means can be moved with an upward and downward component of travel while maintaining parallel alignment.

28. The machine as recited in claim 27, wherein said roof shield mechanism comprises cylinder means operatively engaged between said support structure and said crown engaging plate means to cause movement.

29. A tunnel boring machine adapted to bore a tunnel into a ground strata, said machine having a front end, a rear end, and a longitudinal axis, said machine comprising:

a. a forward positioned head section, comprising:

i. a cutter head having a forward cutting face and a perimeter portion, and being mounted in said head section for rotation about the longitudinal axis;

ii. a support structure to which said cutting head is rotatably mounted in a manner that torque and thrust loads from said cutting head are reacted into said support structure;

iii. a gripper and propel assembly comprising gripper shoe means operatively connected to said head section at circumferentially spaced locations, and a gripper and propel actuating means operatively connected between said gripper shoes and said head section to press said shoes into gripping tunnel wall engagement and cause relative longitudinal travel of said shoes relative to said support structure to advance said machine;

b. an elongate longitudinally aligned beam structure having a forward end connected to said head section and extending rearwardly therefrom;

c. a gantry means operatively connected to said beam structure rearwardly of said support structure and having tunnel engaging pad means to locate said beam structure relative to said support structure.

30. The machine as recited in claim 29, further comprising positioning means operatively connected between said head section and said beam structure to cause relative rotation between said support structure and said beam structure about axes transverse to said longitudinal axis for vertical and lateral alignment and positioning adjustment.

31. The machine as recited in claim 30, wherein said positioning means comprises a plurality of positioning cylinders laterally and vertically spaced from one another and interconnected between said beam structure and said support structure, whereby extending and retraction said positioning cylinders selectively causes said relative rotation of said support structure relative to said beam structure.

32. The machine as recited in claim 29, wherein there is positioning means operatively connected between said beam structure and said support structure, to cause relative rotation of said support structure relative to said beam structure about said longitudinal axis, to orient said support structure to said beam structure relative to roll.

33. The machine as recited in claim 32, wherein said positioning means comprises cylinder means spaced laterally from said longitudinal axis, and aligned to exert rotational force components between said beam structure and said support structure.

34. The machine as recited in claim 29, wherein said beam structure has at its forward end a universal connection to said support structure to permit relative rotation of said support structure, relative to said beam structure, about axes perpendicular to said longitudinal axis, for alignment and correction of alignment of said support structure both vertically and laterally, said machine further comprising positioning means to cause said relative rotation.

35. A tunnel boring machine adapted to bore a tunnel into a ground strata, said machine comprising:

a. a cutter head having a forward cutting face and a perimeter portion, and being mounted for rotation about a longitudinal axis;

b. a support structure to which said cutter head is rotatably mounted in a manner that torque and thrust loads from said cutting head are reacted into said support structure;

c. a gripper and propel assembly comprising gripper shoe means positioned on opposite sides of said support structure, and gripper and propel actuating mechanism means to operate said shoes to advance said machine;

d. a support shoe mechanism means positioned below said support structure and in operative engagement therewith, said support shoe mechanism means comprising tunnel invert engaging shoe means and link mean positioned between said shoe means and said support structure to permit relative longitudinal movement between said support shoe means and said support structure while maintaining substantially constant vertical spacing therebetween;

e. said link means being pivotally mounted for rotational movement, said link means further comprising bearing surface means having a curved bearing surface relative to a pivot mounting location of said link means to provide said constant vertical spacing.

36. The machine as recited in claim 35, wherein said link means is pivotally connected to said support shoe means for rotation about a pivot location, and extends upwardly from said pivot location, said link means have an upwardly facing bearing surface curved circularly about said pivot location, said bearing surface engaging a matching bearing surface of said support structure so as to be in rolling contact therewith and thus provide said constant vertical spacing.

37. The machine as recited in claim 36, wherein said support shoe mechanism means further comprises shoe actuating means to move said support shoe means longitudinally relative to said support structure.

38. A tunnel boring machine adapted to bore a tunnel into a ground strata, said machine comprising:

a. a cutter head having a forward cutting face and a perimeter portion, and being mounted for rotation about a longitudinal axis;

b. a support structure to which said cutter head is rotatably mounted in a manner that torque and thrust loads from said cutter head are reacted into said support structure;

c. a gripper and propel assembly comprising gripper shoes positioned on opposite sides of said support structure adjacent to, and rearwardly of, the perimeter portion of the cutter head, and an actuating means operatively connected between said gripper shoes and said support structure to exert both radial and longitudinal force components from said support structure to said gripper shoes to press said gripper shoes into gripping tunnel wall engagement and to advance said machine d. a roof shield mechanism positioned above said support structure adjacent to, and rearwardly of, an upper perimeter portion of said cutter head, said roof shield mechanism comprising a tunnel crown engaging plate means, and force transmitting means positioned operatively between said support structure and said plate means to press said plate means upwardly into tunnel inverting engagement.

39. The machine as recited in claim 38, wherein said roof shield mechanism comprises a parallel linkage interconnecting said structure and said plate means, whereby said plate support means can be moved with an upward and downward component of travel while maintaining parallel alignment.

40. The machine as recited in claim 39, wherein said roof shield mechanism comprises cylinder means operatively engaged between said support structure and said crown engaging plate means to cause movement of said plate means relative to said parallel linkage.

41. A method of boring a tunnel into a ground strata, said method comprising:

a. providing a machine comprising:

i. a cutter head having a forward cutting face and a perimeter portion, and being mounted for rotation about a longitudinal axis;

ii. a support structure to which said cutter head is rotatably mounted in a manner that torque and thrust loads from said cutter head are reacted into said support structure;

iii. a plurality of gripper shoes positioned at circumferentially spaced locations adjacent to, and rearwardly of, the perimeter portion of the cutter head;

iv. a plurality of gripper and propel actuating mechanisms operatively connected between said gripper shoes and said support structure;

b. operating said actuating mechanisms to exert selectively both radial and longitudinal force components from said support structure to said gripper shoes to press said gripper shoes into gripping tunnel wall engagement and cause longitudinal travel of said shoes relative to said support structure to advance said support structure with the cutter head while reacting loads from the cutter head to the said support structure, through the gripper and propel actuating mechanisms, and through the gripper shoes into adjacent ground strata.

42. The method as recited in claim 41, wherein said gripper shoes are located in two sets spaced laterally from one another on opposite sides of said support structure, said method further comprising providing a roof shield mechanism positioned above said support structure adjacent to, and rearwardly of, an upper perimeter portion of said cutter head, said roof shield mechanism comprising a tunnel crown engaging plate means, then operating force transmitting means positioned operatively between said support structure and said plate support means to press said plate support means upwardly into tunnel crown engagement to inhibit downward movement of said tunnel crown.

43. The method as recited in claim 41, said method further comprising providing a roof shield mechanism positioned above said support structure adjacent to, and rearwardly of, an upper perimeter portion of said cutter head, said roof shield mechanism comprising a tunnel crown engaging plate means, then operating force transmitting means positioned operatively between said support structure and said plate support means to press said plate support means upwardly into tunnel crown engagement to inhibit downward movement of said tunnel crown.

44. The method as recited in claim 43, wherein said roof shield mechanism means comprises a parallel linkage interconnecting said support structure and said plate support means, said method further comprising moving said plate support means with upward and downward components of travel while maintaining parallel alignment.

45. The method as recited in claim 44, wherein said roof shield mechanism comprises cylinder means operatively engaged between said support structure and said crown engaging plate means, said method further comprising operating said cylinder means to move said plate means.

* * * * *